US009073306B2

(12) United States Patent
Ohkawa et al.

(10) Patent No.: US 9,073,306 B2
(45) Date of Patent: Jul. 7, 2015

(54) INK JET RECORDING APPARATUS AND PRINTING METHOD

(71) Applicant: MIMAKI ENGINEERING CO., LTD., Tomi (JP)

(72) Inventors: Masakatsu Ohkawa, Tomi (JP); Akira Ikeda, Tomi (JP)

(73) Assignee: MIMAKI ENGINEERING CO., LTD., Tomi (JP)

( * ) Notice: Subject to any disclaimer, the term of this patent is extended or adjusted under 35 U.S.C. 154(b) by 0 days.

(21) Appl. No.: 14/017,213

(22) Filed: Sep. 3, 2013

(65) Prior Publication Data

US 2014/0002560 A1 Jan. 2, 2014

Related U.S. Application Data

(63) Continuation of application No. PCT/JP2012/055585, filed on Mar. 5, 2012.

(30) Foreign Application Priority Data

Mar. 4, 2011 (JP) ..... 2011-047355

(51) Int. Cl.
*B41J 11/02* (2006.01)
*B41J 2/01* (2006.01)
*B41J 11/00* (2006.01)

(52) U.S. Cl.
CPC . *B41J 2/01* (2013.01); *B41J 11/002* (2013.01)

(58) Field of Classification Search
CPC ..... B41J 11/002; B41J 2002/0055
USPC ..... 347/101, 102, 20, 5, 9
See application file for complete search history.

(56) References Cited

U.S. PATENT DOCUMENTS 7,123,854 B1 * 10/2006 Cellura et al. ..... 399/92
2009/0086000 A1 * 4/2009 Yokota ..... 347/102

(Continued)

FOREIGN PATENT DOCUMENTS

JP 2005-199563 7/2005
JP 2005-271557 10/2005

(Continued)

OTHER PUBLICATIONS

International Search Report for corresponding International Application No. PCT/JP2012/055585, Apr. 10, 2012.

(Continued)

*Primary Examiner* — Julian Huffman
*Assistant Examiner* — Sharon A Polk
(74) *Attorney, Agent, or Firm* — Mori & Ward, LLP

(57) ABSTRACT

An ink jet recording apparatus includes a carriage movable in a main scanning direction and relatively movable with respect to a recording medium in a sub-scanning direction perpendicular to the main scanning direction. An ink ejector is mounted on the carriage and includes a plurality of ink nozzles which are provided in the sub-scanning direction to eject ultraviolet-ray curable inks and which are arranged in a plurality of pass areas to record a plurality of bands. An ultraviolet-ray irradiator is mounted on the carriage to irradiate the recording medium with ultraviolet rays and includes a plurality of light sources to irradiate the plurality of bands with ultraviolet rays, respectively. A gas flowing device includes at least one of an air sucking device to suck air on the recording medium side and a blowing device to blow a gas toward the recording medium side.

8 Claims, 28 Drawing Sheets

(56) References Cited

U.S. PATENT DOCUMENTS

| | | | | |
|---|---|---|---|---|
| 2009/0284574 | A1* | 11/2009 | Niekawa | 347/102 |
| 2010/0194838 | A1 | 8/2010 | Mitsuzawa | |
| 2012/0194598 | A1* | 8/2012 | Fujisawa et al. | 347/16 |
| 2012/0287214 | A1* | 11/2012 | Fujisawa | 347/102 |

FOREIGN PATENT DOCUMENTS

| | | | |
|---|---|---|---|
| JP | 2010000735 | A * | 1/2010 |
| JP | 2010-58441 | | 3/2010 |
| JP | 2010-173308 | | 8/2010 |
| JP | 2010-179537 | | 8/2010 |
| JP | 2011235495 | A * | 11/2011 |
| WO | WO 2010/061904 | | 6/2010 |

OTHER PUBLICATIONS

Written Opinion for corresponding International Application No. PCT/JP2012/055585, Apr. 10, 2012.

* cited by examiner

INK JET RECORDING APPARATUS AND PRINTING METHOD

CROSS-REFERENCE TO RELATED APPLICATIONS

The present application is a continuation application of International Application No. PCT/JP2012/055585, filed Mar. 5, 2012, which claims priority to Japanese Patent Application No. 2011-047355, filed Mar. 4, 2011. The contents of these applications are incorporated herein by reference in their entirety.

BACKGROUND OF THE INVENTION

1. Field of the Invention

The present invention relates to an ink jet recording apparatus and a printing method.

2. Discussion of the Background

JP-A-2005-199563 discloses an ink jet recording apparatus using an ultraviolet-ray curable ink. A carriage mounted in this ink jet recording apparatus is provided with a color ink recording head, a clear ink recording head, and an ultraviolet-ray irradiation device, in which the ultraviolet-ray irradiation device is disposed further toward the downstream side in a transfer direction of a recording medium than the color ink recording head, and the ultraviolet-ray irradiation device is also disposed further toward the downstream side in the transfer direction of the recording medium than the clear ink recording head. In addition, an amount of light to be applied by the ultraviolet-ray irradiation device is controlled depending on image quality, and the ultraviolet-ray irradiation device is located between a recording head which ejects an ink earlier of the color ink recording head and the clear ink recording head and a recording head which ejects an ink later.

SUMMARY OF THE INVENTION

According to one aspect of the present invention, an ink jet recording apparatus includes a carriage movable in a main scanning direction and relatively movable with respect to a recording medium in a sub-scanning direction perpendicular to the main scanning direction. An ink ejector is mounted on the carriage and includes a plurality of ink nozzles which are provided in the sub-scanning direction to eject ultraviolet-ray curable inks on the recording medium and which are arranged in a plurality of pass areas to record a plurality of bands. An ultraviolet-ray irradiator is mounted on the carriage to irradiate the recording medium with ultraviolet rays and includes a plurality of light sources to irradiate the plurality of bands with ultraviolet rays, respectively. A controller is configured to control the ink ejector and the plurality of light sources of the ultraviolet-ray irradiator to be turned on and turned off corresponding to respective pass areas. A gas flowing device includes at least one of an air sucking device to suck air on the recording medium side and a blowing device to blow a gas toward the recording medium side.

According to another aspect of the present invention, in a printing method using the ink jet recording apparatus, the light source irradiating the band where the pass area for ejecting light-transmissive ultraviolet-ray curable inks is located with ultraviolet rays is turned off, and the light-transmissive ultraviolet-ray curable inks are recorded on a recording medium. The method includes a step of turning on the light source irradiating the band where a pass area disposed further toward an upstream side of the carriage or the recording medium in the sub-scanning direction than the pass area for ejecting the light-transmissive ultraviolet-ray curable inks is located with ultraviolet rays, so as to cure the ultraviolet-ray curable inks recorded on the recording medium in subsequent scannings. The method further includes a step of sucking air on the recording medium side by operating the air sucking device or a step of blowing a gas toward the recording medium side by operating the blowing device before, when, or after the ultraviolet-ray curable inks are ejected.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
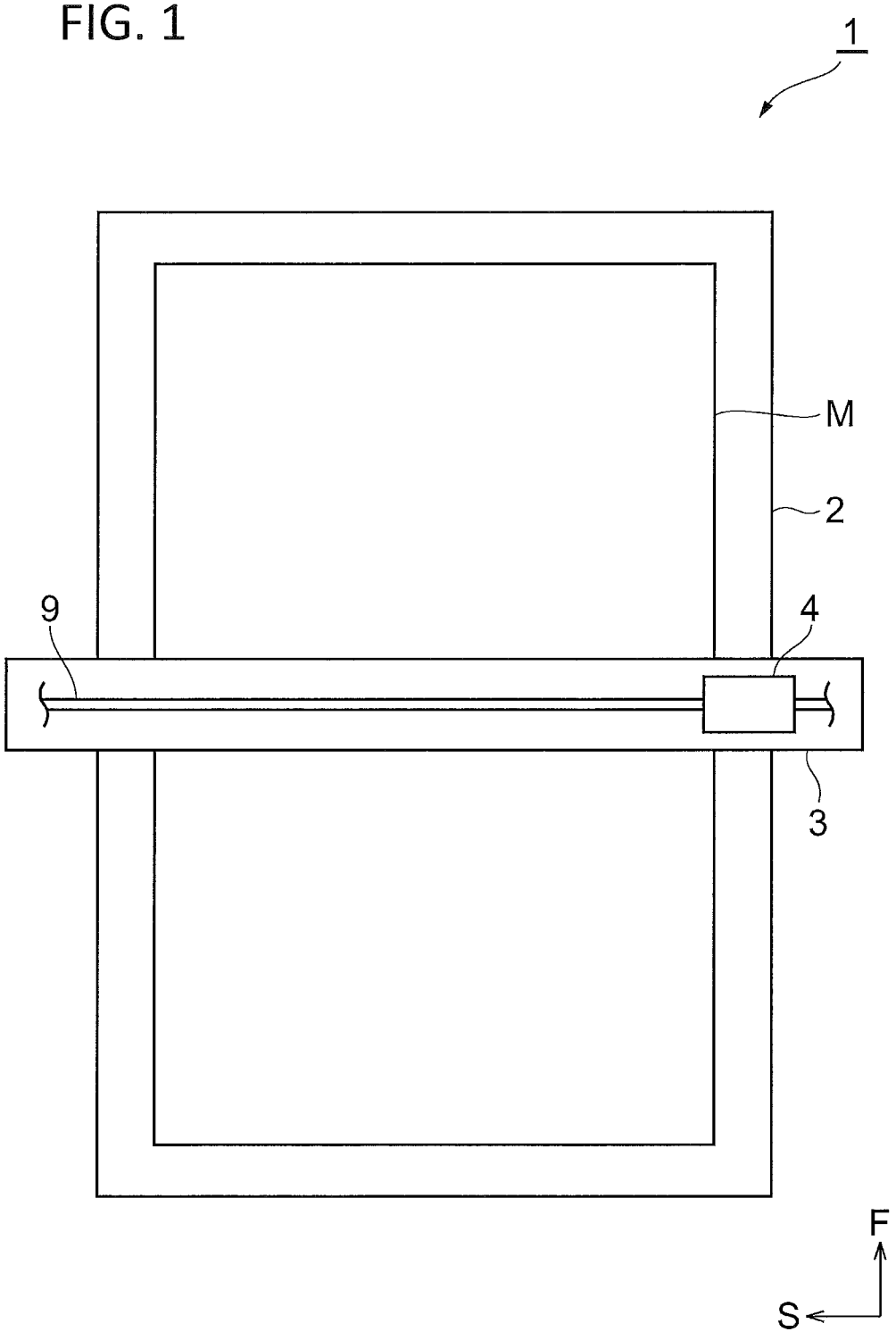
FIG. 1 is a schematic diagram illustrating an ink jet recording apparatus according to an embodiment.

The embodiments will now be described with reference to the accompanying drawings, wherein like reference numerals designate corresponding or identical elements throughout the various drawings.

Hereinafter, with reference to the drawings, an ink jet recording apparatus according to an embodiment of the present invention will be described in detail. The ink jet recording apparatus according to the embodiment is an ink jet printer which performs printing using an ultraviolet-ray curable ink, and records an image through multi-pass printing in which an image of one band is formed in a plurality of passes. In addition, similar or corresponding parts are given the same reference numerals throughout all the drawings.

Figure 2:
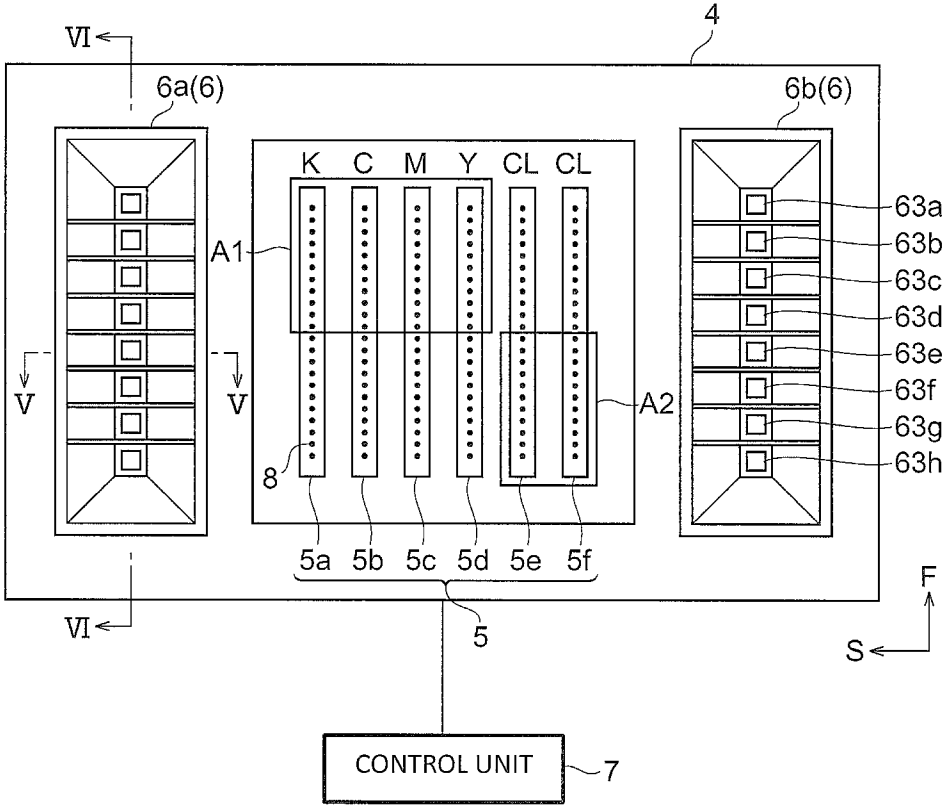
FIG. 2 is an enlarged view of a carriage shown in FIG. 1.

FIG. 1 is a schematic diagram illustrating the ink jet recording apparatus according to the embodiment, and FIG. 2 is an enlarged view of the carriage shown in FIG. 1. As shown in FIGS. 1 and 2, the ink jet recording apparatus 1 according to the embodiment includes a flat bed 2 on which a medium M which is a recording medium is placed, a Y bar 3 which is disposed over the flat bed 2 and can move in a sub-scanning direction F, a carriage 4 which is mounted on the Y bar 3 and can move in a main scanning direction S perpendicular to the sub-scanning direction F, a plurality of ink jet heads 5 (5*a* to 5*f*) which are mounted on the carriage 4 and eject ink droplets, a pair of ultraviolet-ray irradiation devices 6 (6*a* and 6*b*) which are disposed on the front side (the left side in FIG. 1) and the rear side (the right side in FIG. 1) of the ink jet heads 5 mounted on the carriage 4 in the main scanning direction S, and a control unit (controller) 7 which collectively controls the ink jet recording apparatus 1. In addition, it is considered that dust removal means (details thereof will be described later) is provided. Further, the main scanning direction S is a direction in which a band of an image is recorded on the medium M by reciprocating the carriage 4, and the sub-scanning direction F is a direction in which a position of a band recorded on the medium M is shifted by relatively moving the Y bar 3 with respect to the medium M. Furthermore, in the ink jet recording apparatus 1, under the control of the control unit 7, when the carriage 4 is reciprocated in the main scanning direction S while the Y bar 3 is transported by a predetermined pass width in the sub-scanning direction F, the ultraviolet-ray curable ink is ejected from the ink jet heads 5 and the ultraviolet-ray irradiation devices 6 irradiate ultraviolet rays, thereby recording an image on the medium. In addition, the front side in the main scanning direction S is a direction (the left side in FIG. 1) in which the carriage 4 moves in the main scanning direction S, and the rear side in the main scanning direction S is a direction (the right side in FIG. 1) in which the carriage 4 moves in the opposite direction to the main scanning direction S. Further, the front side in the sub-scanning direction F is a direction (the upper side in FIG. 1) in which the Y bar 3 moves in the sub-scanning direction F, and the rear side in the sub-scanning direction F is a direction (the lower side in FIG. 1) in which the Y bar 3 moves in the opposite direction to the sub-scanning direction F.

The Y bar 3 transports the carriage 4 in the sub-scanning direction F with respect to the flat bed 2. The Y bar 3 is placed on, for example, guide rails (not shown) extending in the sub-scanning direction F so as to be movable, and can be reciprocated in the sub-scanning direction F along the guide rails by being driven by a driving mechanism (not shown) such as a driving motor. In addition, during forward movement in which the Y bar 3 moves in the sub-scanning direction F, the rear side in the sub-scanning direction F is an upstream side in the sub-scanning direction F of the Y bar 3, and the front side in the sub-scanning direction F is a downstream side in the sub-scanning direction F of the Y bar 3. Further, during return movement in which the Y bar 3 moves in the opposite direction to the sub-scanning direction F, the front side in the sub-scanning direction F is an upstream side in the sub-scanning direction F of the Y bar 3, and the rear side in the sub-scanning direction F is a downstream side in the sub-scanning direction F of the Y bar 3.

The carriage 4 transports the ink jet heads 5, the ultraviolet-ray irradiation devices 6, and the like in the main scanning direction S with respect to the flat bed 2. The carriage 4 is held in, for example, a guide rail 9 extending in the main scanning direction S so as to be movable, and can be reciprocated in the main scanning direction S along the guide rail 9 by being driven by a driving mechanism (not shown) such as a driving motor. In addition, during forward movement in which the carriage 4 moves in the main scanning direction S, the rear side in the main scanning direction S is an upstream side in the main scanning direction S of the carriage 4, and the front side in the main scanning direction S is a downstream side in the main scanning direction S of the carriage 4. Further, during return movement in which the carriage 4 moves in the opposite direction to the main scanning direction S, the front side in the main scanning direction S is an upstream side in the main scanning direction S of the carriage 4, and the rear side in the main scanning direction S is a downstream side in the main scanning direction S of the carriage 4.

The ink jet heads 5*a* to 5*f* are arranged in parallel in the main scanning direction S, and the ink jet head 5*a*, the ink jet head 5*b*, the ink jet head 5*c*, the ink jet head 5*d*, the ink jet head 5*e*, and the ink jet head 5*f* are arranged in this order from the front side in the main scanning direction S. In addition, each of the ink jet heads 5 is mounted on the carriage 4, and thus can eject the ultraviolet-ray curable ink while moving in the main scanning direction S according to scanning of the carriage 4.

A plurality of ink nozzles 8 which eject the ultraviolet-ray curable ink as ink droplets are formed in each of the ink jet heads 5. The plurality of ink nozzles 8 are arranged so as to extend in the sub-scanning direction F and form a nozzle string. Colored ultraviolet-ray curable inks (hereinafter, also referred to as "color inks") are ejected from the respective ink nozzles 8 of the ink jet heads 5*a* to 5*d* disposed on the front side in the main scanning direction S, and light-transmissive ultraviolet-ray curable inks (hereinafter, also referred to as "clear inks") are ejected from the respective ink nozzles 8 of the ink jet heads 5*e* and 5*f* disposed on the rear side in the main scanning direction S. Specifically, color inks of black (K) are ejected from the respective ink nozzles 8 of the ink jet head 5*a*, color inks of cyan (C) are ejected from the respective ink nozzles 8 of the ink jet head 5*b*, color inks of magenta (M) are ejected from the respective ink nozzles 8 of the ink jet head 5*c*, and color inks of yellow (Y) are ejected from the respective ink nozzles 8 of the ink jet head 5*d*. In addition, clear inks (CL) are ejected from the respective ink nozzles 8 of the ink jet heads 5*e* and 5*f*.

Further, among the ink nozzles 8 formed in the ink jet heads 5*a* to 5*d*, the color inks are ejected only from the ink nozzles 8 of a first ejection area A1 disposed in the first half in the sub-scanning direction F, and the color inks are not ejected from the ink nozzles 8 disposed in the second half in the sub-scanning direction F. On the other hand, among the ink nozzles 8 formed in the ink jet heads 5*e* and 6*f*, the clear inks are ejected only from the ink nozzles 8 of a second ejection area A2 disposed in the second half in the sub-scanning direction F, and the clear inks are not ejected from the ink nozzles 8 disposed in the first half in the sub-scanning direction F. For this reason, when the Y bar 3 moves in the sub-scanning direction F, first, ink droplets of the color inks ejected from the first ejection area A1 of the ink jet heads 5*a* to 5*d* are recorded on the medium M placed on the flat bed 2, and, then, ink droplets of the clear inks ejected from the second ejection area A2 of the ink jet heads 5*e* and 5*f* are recorded on surfaces (upper layer) of the color inks.

The ultraviolet-ray irradiation device 6*a* is disposed on the front side in the main scanning direction S of the ink jet heads 5, and the ultraviolet-ray irradiation device 6*b* is disposed on the rear side in the main scanning direction S of the ink jet heads 5. The ultraviolet-ray irradiation device 6*a* and the ultraviolet-ray irradiation device 6*b* have the same configuration, and irradiate the ultraviolet-ray curable inks recorded on the medium with ultraviolet rays so as to cure the ultraviolet-ray curable inks. Therefore, hereinafter, the ultraviolet-ray irradiation device 6*a* and the ultraviolet-ray irradiation device 6*b* will be collectively described as the ultraviolet-ray irradiation devices 6. In addition, the ultraviolet-ray irradiation devices 6 are mounted on the carriage 4, and thus can emit ultraviolet rays while moving in the main scanning direction S according to scanning of the carriage 4.

Figure 3:
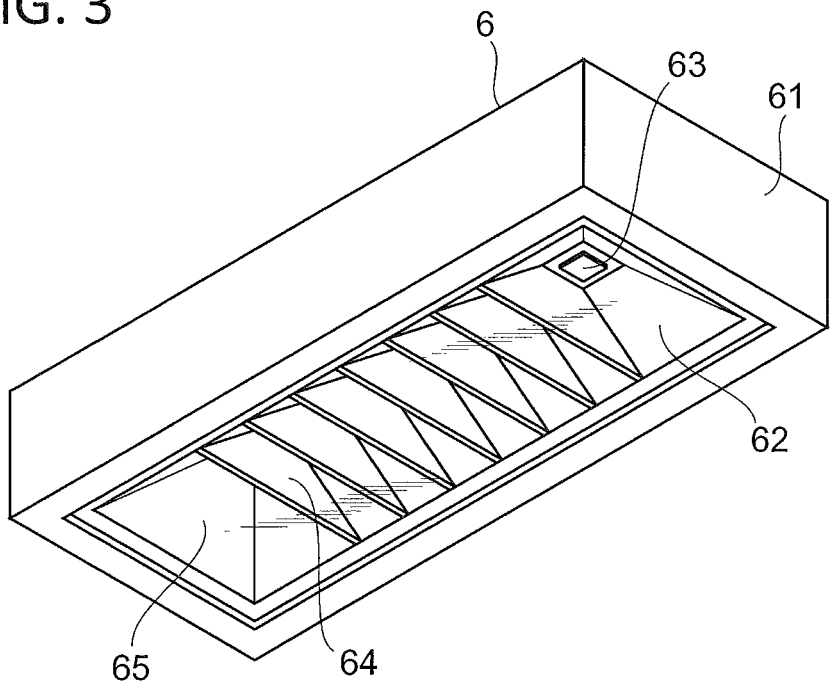
FIG. 3 is a bottom perspective view of an ultraviolet-ray irradiation device.
Figure 4:
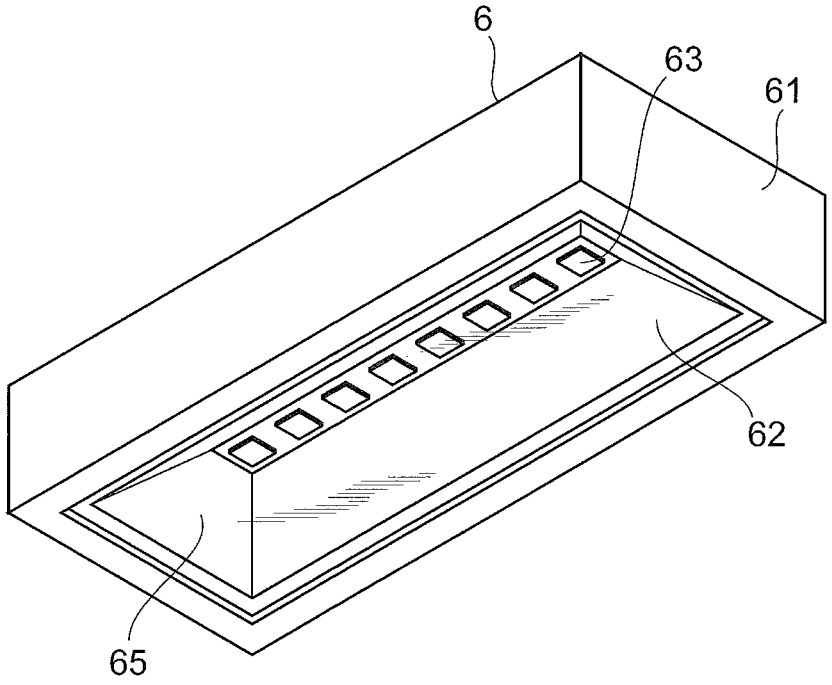
FIG. 4 is a bottom perspective view of the ultraviolet-ray irradiation device from which partition plates are removed.
Figure 5:
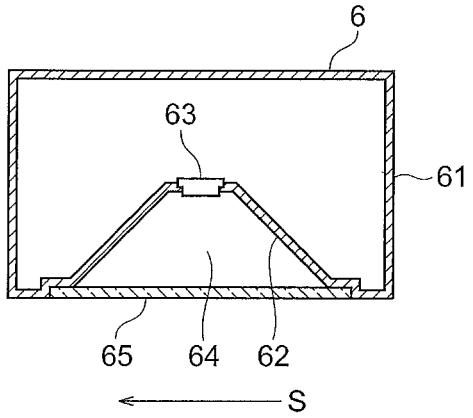
FIG. 5 is a cross-sectional view taken along the line V-V shown in FIG. 2.
Figure 6:
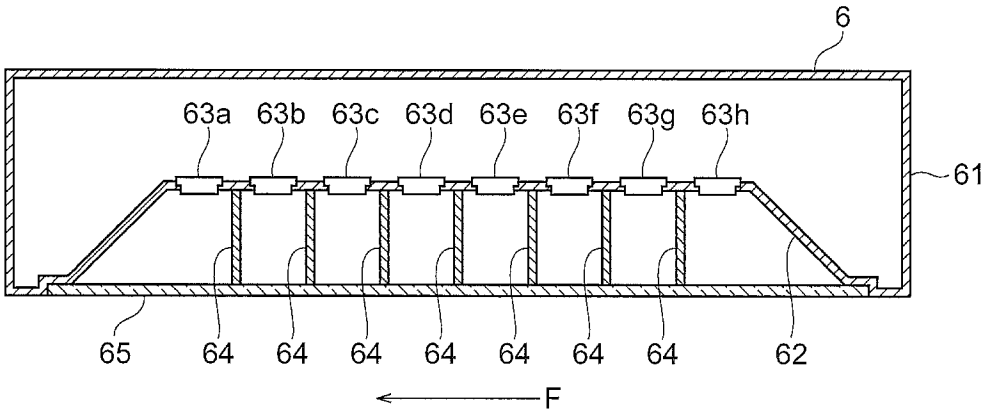
FIG. 6 is a cross-sectional view taken along the line VI-VI shown in FIG. 2.

FIG. 3 is a bottom perspective view of the ultraviolet-ray irradiation device, and FIG. 4 is a bottom perspective view of the ultraviolet-ray irradiation device from which partition plates are removed. FIG. 5 is a cross-sectional view taken along the line V-V shown in FIG. 2, and FIG. 6 is a cross-sectional view taken along the line VI-VI shown in FIG. 2.

As shown in FIGS. 2 to 6, the ultraviolet-ray irradiation device 6 includes a main body 61, a recess 62 formed on the bottom which is a side opposite to the medium M of the main body 61 facing the flat bed 2, a plurality of UVLEDs 63 (ultraviolet-ray light emitting diodes) disposed in the recess 62, and a plurality of partition plates 64 disposed in the recess 62.

As shown in FIG. 5, the recess 62 reflects ultraviolet rays, which are emitted from the UVLEDs 63 and are spread in the main scanning direction S, vertically downward toward the flat bed 2, and has a mirror surface. The recess 62 is formed in an elongated mortar shape in the sub-scanning direction F. Specifically, the recess 62 is a truncated square pyramid of which the bottom is small and the opening side is large, and is formed in an umbrella shape in which each inner surface is spread at an angle of about 60° with respect to the vertical lower side. For this reason, the recess 62 is a trapezoid of which the width of the cross-section in the main scanning direction S is small (refer to FIG. 5) and the width of the cross-section in the sub-scanning direction F is large (refer to FIG. 6).

In addition, an ultraviolet-ray transmissive and transparent cover 65 (for example, quartz glass) is fitted into a rectangular opening formed in the lower end surface of the recess 62 from the vertical lower side. Thus, the opening of the recess 62 can be closed and ultraviolet rays emitted from the UVLEDs 63 can be transmitted.

The respective UVLEDs 63 are disposed at the most depressed positions of the central bottom of the recess 62, and are arranged in a line at the same interval in the sub-scanning direction F. In addition, the plurality of UVLEDs 63 are respectively disposed at positions corresponding to the first ejection area A1 of the ink jet heads 5*a* to 5*d* and the second ejection area A2 of the ink jet heads 5*e* and 5*f* in the main scanning direction S.

Meanwhile, in a case where multi-pass printing is performed by the ink jet recording apparatus 1, it is possible to record a plurality of bands in a plurality of passes by using ink droplets ejected from the first ejection area A1 and the second ejection area A2, respectively. For this reason, the first ejection area A1 and the second ejection area A2 are pass areas.

Therefore, in the present embodiment, eight UVLEDs 63 are mounted in the ultraviolet-ray irradiation device 6, and four UVLEDs 63 are disposed at positions corresponding to each of the first ejection area A1 and the second ejection area A2 in the main scanning direction S. Here, to dispose four UVLEDs 63 at the positions corresponding to the first ejection area A1 is in a disposition relationship in which ink droplets ejected from the first ejection area A1 and landed on the medium M can be cured by the four UVLEDs 63, that is, the UVLEDs 63*a*, 63*b*, 63*c* and 63*d*, and indicates that the UVLEDs 63*a*, 63*b*, 63*c* and 63*d* are disposed at positions where a band recorded by the first ejection area A1 can be cured through irradiation with ultraviolet rays when the band is recorded by ejecting ink droplets from the first ejection area A1 while moving the carriage 4 in the main scanning direction S. In addition, to dispose four UVLEDs 63 at the positions corresponding to the second ejection area A2 is in a disposition relationship in which ink droplets ejected from the second ejection area A2 and landed on the medium M can be cured by the four UVLEDs 63, that is, the UVLEDs 63*e*, 63*f*, 63*g* and 63*h*, and indicates that the UVLEDs 63*e*, 63*f*, 63*g* and 63*h* are disposed at positions where a band recorded by the second ejection area A2 can be cured through irradiation with ultraviolet rays when the band is recorded by ejecting ink droplets from the second ejection area A2 while moving the carriage 4 in the main scanning direction S. The UVLEDs 63 disposed at the positions corresponding to the first ejection area A1 are arranged in an order of the UVLEDs 63*a*, the UVLED 63*b*, the UVLED 63*c*, and the UVLED 63*d* from the front side in the sub-scanning direction F, and the UVLEDs 63 disposed at the positions corresponding to the second ejection area A2 are arranged in an order of the UVLEDs 63*e*, the UVLED 63*f*, the UVLED 63*g*, and the UVLED 63*h* from the front side in the sub-scanning direction F. For this reason, one UVLED 63 is correlated with one band in a case where multi-pass printing of eight passes is performed, two UVLEDs 63 are correlated with one band in a case where multi-pass printing of four passes is performed, and four UVLEDs 63 are correlated with one band in a case where multi-pass printing of two passes is performed.

In addition, since ultraviolet rays with high directivity are applied from each of the UVLEDs 63, illuminance in a direction tilted by 60° from the vertical direction is about 50% of vertical illuminance.

Each of the partition plates 64 controls irradiation of ultraviolet rays in the sub-scanning direction F and is formed in a plate shape which stands vertically and extends in the main scanning direction S. The partition plate 64 is formed in a trapezoidal shape with the approximately same dimension as the cross-section of the recess 62 in the main scanning direction S, and has a shape which reaches the vicinity of the opening from the bottom of the recess 62 in a state of adhering to the inner surface of the recess 62. For this reason, by installing the partition plates 64 in the recess 62, the space between the recess 62 and the partition plates 64 is closed without gaps, and thus a structure is formed in which ultraviolet rays cannot leak out of the space between the recess 62 and the partition plates 64, which functions as a shield portion. In addition, the partition plates 64 are preferably maximally extended to the opening side of the recess 62 in a range without impeding fitting the cover 65 into the opening of the recess 62, and, for example, there may be a dimension in which the partition plates 64 exactly comes into contact with the cover 65 when the cover 65 is fitted into the opening of the recess 62.

The partition plates 64 are disposed between the adjacent UVLEDs 63 and are installed so as to be individually inserted into and removed from the ultraviolet-ray irradiation device 6. For this reason, a maximum of seven partition plates 64 are installed in the ultraviolet-ray irradiation device 6 in which eight UVLEDs 63 are mounted (refer to FIG. 3), and all the partition plates 64 can be removed (refer to FIG. 4).

Figure 7:
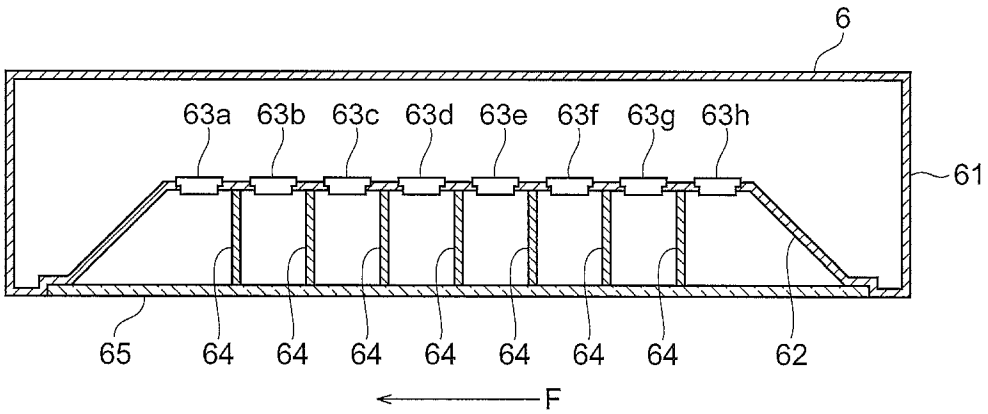
FIG. 7 is a diagram illustrating an irradiation direction of ultraviolet rays when partition plates are installed between all UVLEDs.

FIG. 7 is a diagram illustrating irradiation directions of ultraviolet rays when the partition plates are installed in all the UVLEDs. As shown in FIG. 7, when the partition plates 64 are installed between all the UVLEDs 63, ultraviolet rays emitted from the respective UVLEDs 63 travel only vertically downward, and thus are hindered from penetrating into the vertical lower sides of the adjacent UVLEDs 63 on the front and rear sides in the sub-scanning direction F. Therefore, the medium M is irradiated with ultraviolet rays only by the UVLEDs 63 disposed vertically upward and is not irradiated with the ultraviolet rays by the UVLEDs 63 disposed so as to be adjacent on the front and rear sides in the sub-scanning direction F.

The control unit 7 controls the Y bar 3, the carriage 4, the ink jet heads 5, the ultraviolet-ray irradiation devices 6, and the like, so as to perform printing control for recording an image or the like on the medium M placed on the flat bed 2. In addition, the control unit 7 performs recording of image quality of matte, gloss, and thickness heaping through this control. In addition, a mode in which a matte image is formed is referred to as a matte quality mode, a mode in which a gloss image is formed is referred to as a gloss quality mode, a single layer gloss quality mode in which only glass image quality is recorded without forming an image, and a mode in which a thickness heaping image is formed is referred to as a thickness heaping quality mode. The control unit 7 is configured, for example, by using a computer including a CPU, ROM, and RAM as a main body, and each control described above of the control unit 7 is realized by reading predetermined computer software on the CPU or the RAM and operating the software under the control of the CPU.

Next, a description will be made of an example of a case where the ink jet recording apparatus 1 includes dust removal means. The dust removal means is a mechanism which removes dust from a recording medium (here, the medium M) or prevents dust from entering the medium M so as to cause a dust removal operation on the medium M, thereby preventing dust from being attached to ink droplets. Hereinafter, representative examples will be described.

Figure 24:
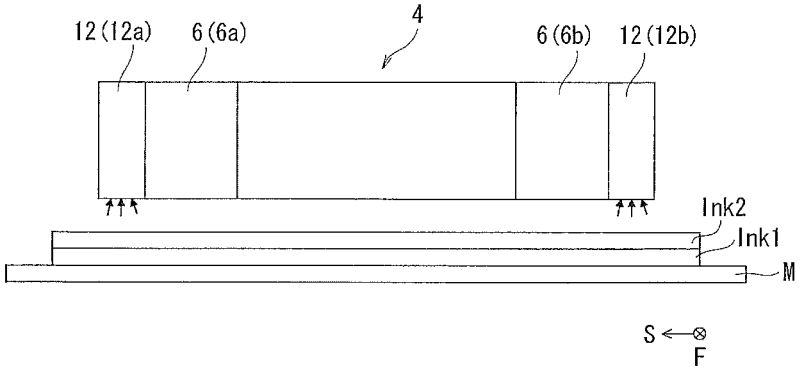
FIG. 24 is a schematic diagram illustrating an example of dust removal means of the ink jet recording apparatus according to the embodiment.

FIG. 24 is a schematic diagram illustrating an example of a case where the ink jet recording apparatus 1 includes air sucking means 12 for sucking air on the medium M side as a first example of the dust removal means. As shown in FIG. 24, the air sucking means 12 is provided in the carriage 4. For example, the air sucking means 12 is preferably disposed at a front end or a rear end of the carriage 4 in the scanning direction (here, the main scanning direction S). The air sucking means 12 (12*a*) corresponds to an example of a case of being provided at the front end, and the air sucking means 12 (12*b*) corresponds to an example of a case of being provided at the rear end, but, for convenience of description, both of the two are shown in a single figure (in FIG. 24).

As the air sucking means 12, well-known sucking mechanisms and decompression mechanisms such as fans and pumps may be employed. In relation to an operation thereof, the air sucking means 12 is operated so as to suck air on the medium M, thereby sucking dust present in air, before, when, and after ink droplets of clear inks are ejected from the carriage 4. Therefore, it is possible to suppress dust from being attached before ink droplets of clear inks ejected on the medium M are cured by the ultraviolet-ray irradiation device 6.

Figure 25A:
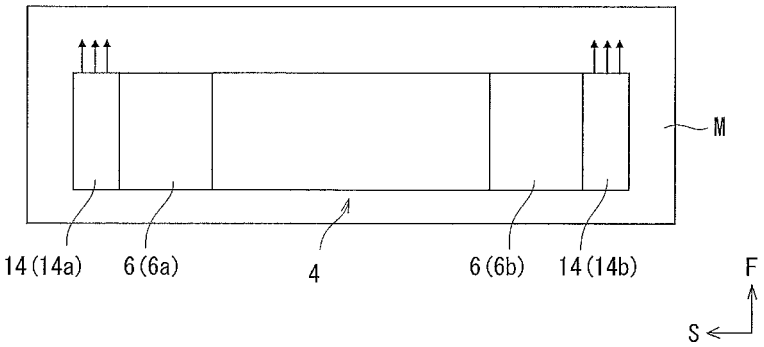
FIGS. 25A and 25B are schematic diagrams illustrating another example of the dust removal means of the ink jet recording apparatus according to the embodiment.
Figure 25B:
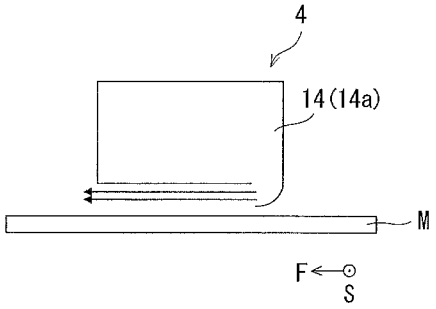

FIGS. 25A and 25B (FIG. 25A: top view, and FIG. 25B: left side view) are schematic diagrams illustrating an example of a case where the ink jet recording apparatus 1 includes blowing means 14 for blowing a gas (for example, air) toward the medium M side as a second example of the dust removal means. As shown in FIGS. 25A and 25B, the blowing means 14 (14*a* and 14*b*) is provided in the carriage 4. For example, the blowing means 14 is preferably disposed at a front end or a rear end of the carriage 4 in the scanning direction (here, the main scanning direction S). The blowing means 14 (14*a*) corresponds to an example of a case of being provided at the front end, and the blowing means 14 (14*b*) corresponds to an example of a case of being provided at the rear end, but, for convenience of description, both of the two are shown in a single figure (in FIG. 25A).

As the blowing means 14, well-known blowing mechanisms such as fans may be employed. In relation to an operation thereof, the blowing means 14 is operated so as to blow air on the medium M, thereby removing dust present in air, before, when, and after ink droplets of clear inks are ejected from the carriage 4. Therefore, it is possible to suppress dust from being attached before ink droplets of clear inks ejected on the medium M are cured by the ultraviolet-ray irradiation device 6.

Particularly, the blowing means 14 is preferably configured to blow a gas in a direction perpendicular to the scanning direction (here, the main scanning direction S) as shown in FIGS. 25A and 25B. According thereto, since a gas is blown in a direction perpendicular to the main scanning direction S, and thus the blown gas does not directly contact with ink droplets which are ejected and are not landed, it is possible to suppress curved flying of the ink droplets.

Figure 26:
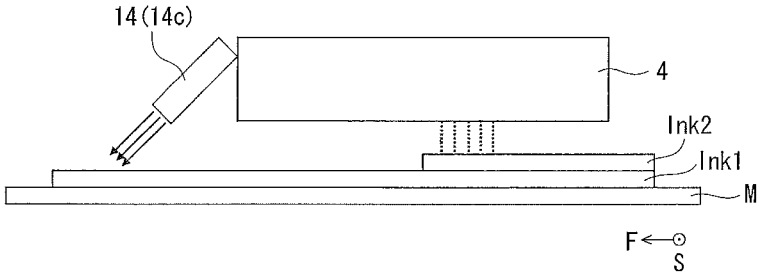
FIG. 26 is a schematic diagram illustrating still another example of the dust removal means of the ink jet recording apparatus according to the embodiment.

In addition, as a modification example, the blowing means 14 (14*c*) may be disposed at the front end of the carriage 4 in the scanning direction (here, the sub-scanning direction F) as shown in FIG. 26. According thereto, a gas is blown toward the front side in the sub-scanning direction F, and thereby it is possible to remove dust present in air on the medium M.

Figure 27:
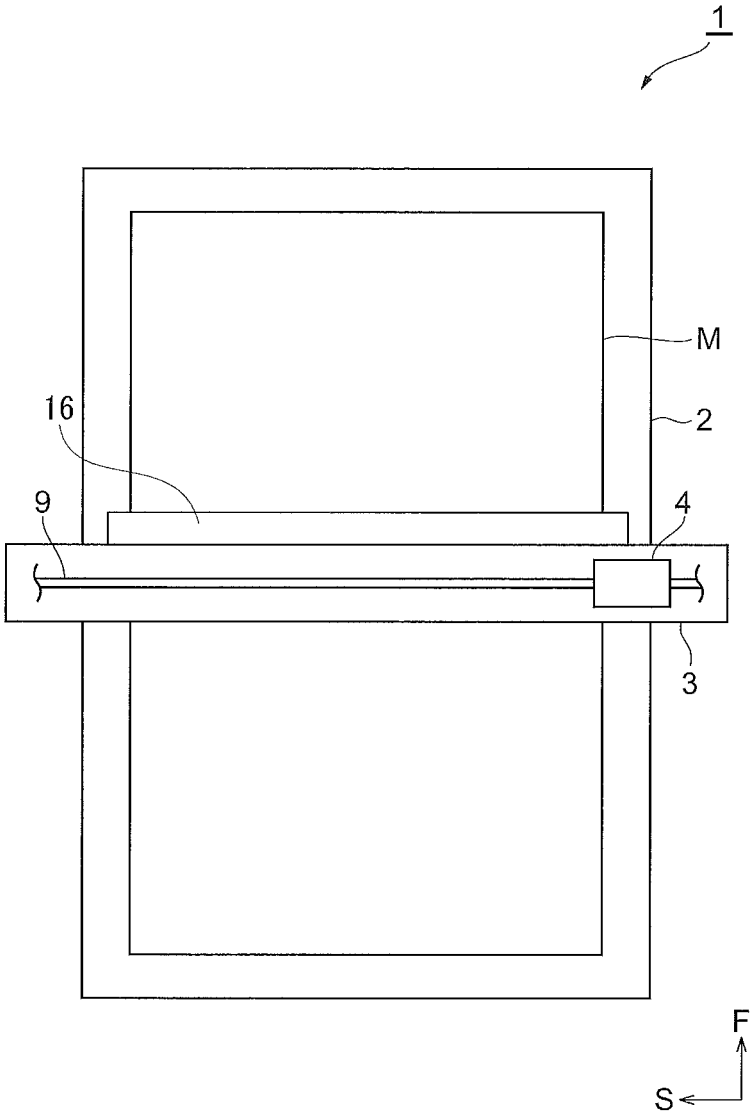
FIG. 27 is a schematic diagram illustrating still another example of the dust removal means of the ink jet recording apparatus according to the embodiment.

FIG. 27 is a schematic diagram illustrating an example of a case where the ink jet recording apparatus 1 includes blowing means 16 for blowing a gas (for example, air) toward the medium M side as a third example of the dust removal means. As shown in FIG. 27, the blowing means 16 is provided in the Y bar 3.

In addition, the blowing means 16 may employ well-known blowing mechanisms such as fans in the same manner as the above-described blowing means 14. In relation to an operation thereof, the blowing means 16 is operated so as to blow air on the medium M, thereby removing dust present in air, before, when, and after ink droplets of clear inks are ejected from the carriage 4. Therefore, it is possible to suppress dust from being attached before ink droplets of clear inks ejected on the medium M are cured by the ultraviolet-ray irradiation device 6.

Further, as a modification example, the blowing means 16 may be disposed in locations (for example, the flat bed 2 and the like) other than the Y bar 3 and the carriage 4 of the ink jet recording apparatus 1 (not shown).

Figure 28:
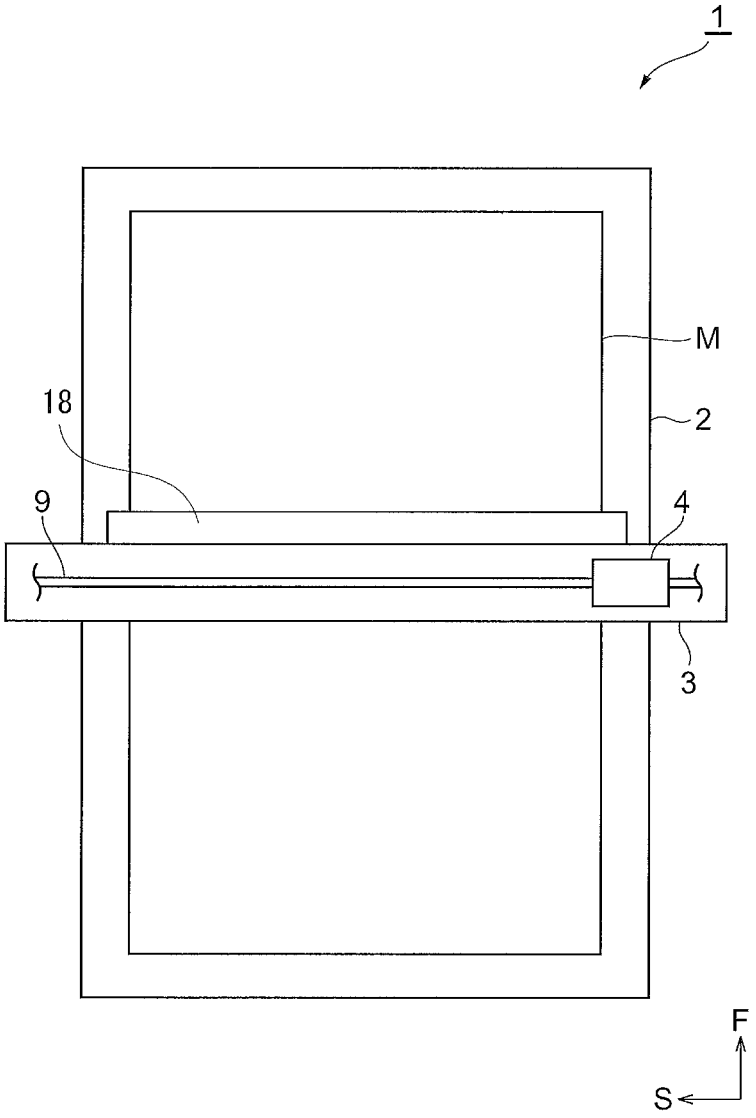
FIG. 28 is a schematic diagram illustrating still another example of the dust removal means of the ink jet recording apparatus according to the embodiment.

FIG. 28 is a schematic diagram illustrating an example of a case where the ink jet recording apparatus 1 includes air sucking means 18 for sucking air on the medium M side as a fourth example of the dust removal means. As shown in FIG. 28, the air sucking means 18 is provided in the Y bar 3.

In addition, the air sucking means 18 may employ well-known sucking mechanisms and decompression mechanisms such as fans and pumps in the same manner as the above-described air sucking means 12. In relation to an operation thereof, the air sucking means 12 is operated so as to suck air on the medium M, thereby sucking dust present in air, before, when, and after ink droplets of clear inks are ejected from the carriage 4. Therefore, it is possible to suppress dust from being attached before ink droplets of clear inks ejected on the medium M are cured by the ultraviolet-ray irradiation device 6.

Further, as a modification example, the air sucking means 18 may be disposed in locations (for example, the flat bed 2 and the like) other than the Y bar 3 and the carriage 4 of the ink jet recording apparatus 1 (not shown).

For example, according to the configuration having the dust removal means exemplified above, the following effects are achieved. That is, even in a case where a predetermined time is required to elapse after ink droplets of clear inks are landed on the medium M until the clear inks are cured, it is possible to prevent deterioration in image quality of glossy printing due to attachment of dust to surfaces of ink droplets during the predetermined time. As a result, it is possible to realize recording with sufficient glossiness by maintaining image quality of glossy printing in high image quality.

Figure 8:
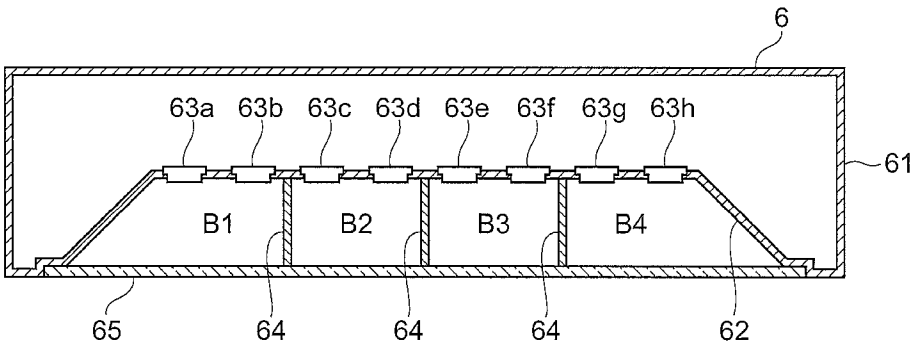
FIG. 8 is a cross-sectional view in a sub-scanning direction of the ultraviolet-ray irradiation device in which three partition plates are installed at the same interval.
Figure 9:
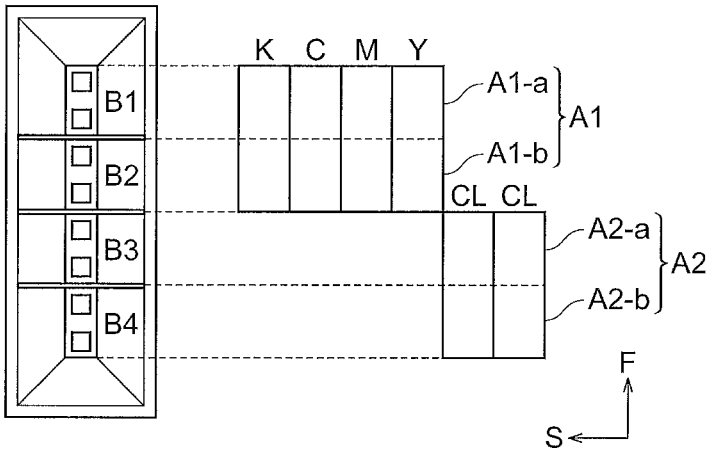
FIG. 9 is a diagram illustrating a relationship between the ultraviolet-ray irradiation device and ink jet heads.

Next, a printing method using the ink jet recording apparatus 1 will be described. In this description, as shown in FIG. 8, it is assumed that three partition plates 64 are installed in the ultraviolet-ray irradiation device 6 at the same interval, and multi-pass printing of four passes is performed in which an image is recorded using color inks in two passes and the image is coated using clear inks in two passes. For this reason, the first ejection area A1 and the second ejection area A2 in FIG. 2 respectively perform recording corresponding to two bands. Therefore, as shown in FIG. 9, in the following description, for convenience, it is assumed that the first half of the first ejection area A1 in the sub-scanning direction F is a "first ejection area A1-*a*", the second half of the first ejection area A1 in the sub-scanning direction F is a "first ejection area A1-*b*", the first half of the second ejection area A2 in the sub-scanning direction F is a "second ejection area A2-*a*", and the second half of the second ejection area A2 in the sub-scanning direction F is a "second ejection area A2-*b*".

In addition, the recess 62 is divided into four areas including an area B1 where the UVLED 63*a* and the UVLED 63*b* are disposed, an area B2 where the UVLED 63*c* and the UVLED 63*d* are disposed, an area B3 where the UVLED 63*e* and the UVLED 63*f* are disposed, and an area B4 where the UVLED 63*g* and the UVLED 63*h* are disposed, by the respective partition plates 64. For this reason, as shown in FIG. 9, the area B1 corresponds to one band of the first ejection area A1-*a*, the area B2 corresponds to one band of the first ejection area A1-*b*, the area B3 corresponds to one band of the second ejection area A2-*a*, and the area B4 corresponds to one band of the second ejection area A2-*b*. Here, the correspondence of the area B1 to one band of the first ejection area A1-*a* is in a disposition relationship in which ink droplets ejected from the first ejection area A1-*a* and landed on the medium M can be cured by two UVLEDs, that is, the UVLEDs 63*a* and 63*b*; the correspondence of the area B2 to one band of the first ejection area A1-*b* is in a disposition relationship in which ink droplets ejected from the first ejection area A1-*b* and landed on the medium M can be cured by two UVLEDs, that is, the UVLEDs 63*c* and 63*d*; the correspondence of the area B3 to one band of the second ejection area A2-*a* is in a disposition relationship in which ink droplets ejected from the second ejection area A2-*a* and landed on the medium M can be cured by two UVLEDs, that is, the UVLEDs 63*e* and 63*f*; and the correspondence of the area B4 to one band of the second ejection area A2-*b* is in a disposition relationship in which ink droplets ejected from the second ejection area A2-*b* and landed on the medium M can be cured by two UVLEDs, that is, the UVLEDs 63*g* and 63*h*. For this reason, in a case where ink droplets are ejected from the first ejection area A1 so as to record a band while moving the carriage 4 in the main scanning direction S, the UVLEDs 63*a* and 63*b* of the area B1 are disposed at positions where a band recorded by the first ejection area A1-*a* can be cured through irradiation with ultraviolet rays, the UVLEDs 63*c* and 63*d* of the area B2 are disposed at positions where a band recorded by the first ejection area A1-*b* can be cured through irradiation with ultraviolet rays, the UVLEDs 63*e* and 63*f* of the area B3 are disposed at positions where a band recorded by the second ejection area A2-*a* can be cured through irradiation with ultraviolet rays, and the UVLEDs 63*g* and 63*h* of the area B4 are disposed at positions where a band recorded by the second ejection area A2-*b* can be cured through irradiation with ultraviolet rays.

Further, a printing operation of the ink jet recording apparatus 1 described below is performed under the control of the control unit 7 as shown in FIG. 2. In other words, in the control unit 7, a processor (not shown) formed by a CPU and the like collectively controls the Y bar 3, the carriage 4, the ink jet heads 5, the ultraviolet-ray irradiation devices 6, and the like, according to a program recorded in a storage device such as a ROM, so as to perform the following processes.

[Matte Quality Mode]

Figure 10:
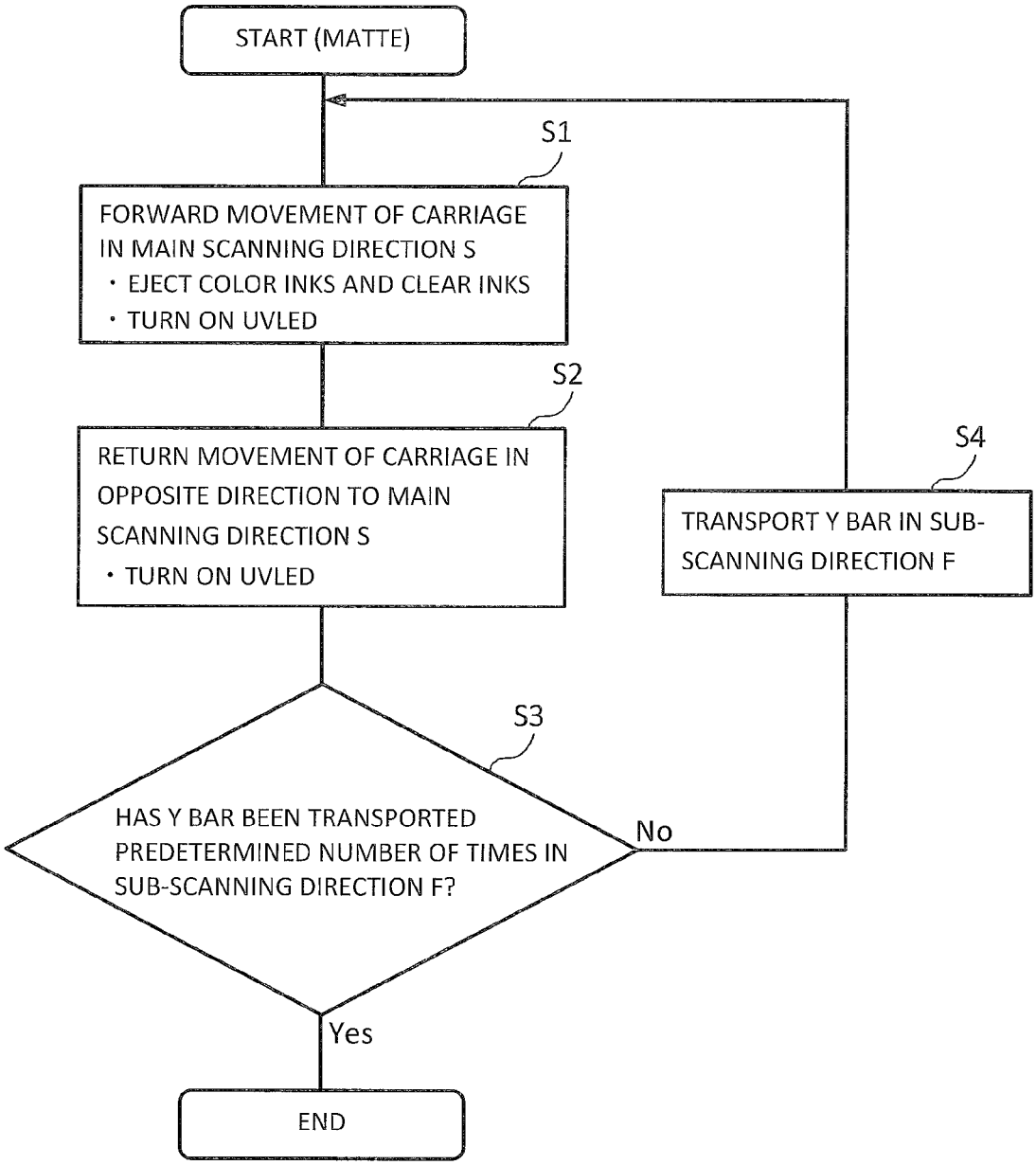
FIG. 10 is a flowchart illustrating a printing process method in a matte quality mode.
Figure 11:
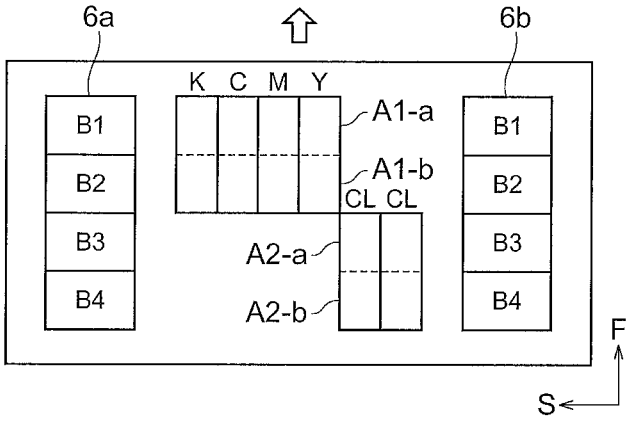
FIG. 11 is a conceptual diagram illustrating an operation aspect example of a carriage in the matte quality mode.

With reference to FIGS. 10 and 11, a description will be made of a printing process method in a matte quality mode. FIG. 10 is a flowchart illustrating a printing process method in the matte quality mode. FIG. 11 is a conceptual diagram illustrating an operation aspect example of the carriage in the matte quality mode. In FIG. 11, the thick arrow indicates a movement direction of the Y bar 3 in the sub-scanning direction F. That is, FIG. 11 shows that the Y bar 3 moves in the sub-scanning direction F. In addition, in the matte quality mode, it is assumed that ultraviolet-ray curable inks are ejected only during forward movement of the carriage 4 in the main scanning direction S, and the ultraviolet-ray curable inks are not ejected during the return movement of the carriage 4 in an opposite direction to the main scanning direction S.

In the matte quality mode, first, the medium M is placed on the flat bed 2, and the Y bar 3 is set at a rear end part (printing start position) in the sub-scanning direction F in a recording area of the medium M.

As shown in FIG. 11, ink droplets of color inks are ejected from the first ejection area A1-*a*, and the UVLEDs 63*a* and 63*b* disposed in the area B1 of the ultraviolet-ray irradiation device 6*b* are turned on in the first scanning during forward movement of the carriage 4 in the main scanning direction S (step S1). In addition, during the return movement of the carriage 4 in the opposite direction to the main scanning direction S, UVLEDs 63 which irradiate the band recorded in step S1 with ultraviolet rays are turned on (step S2). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the first pass recording is performed using the color inks ejected from the first ejection area A1-*a*, and the color inks are irradiated with ultraviolet rays immediately after being landed on the medium M and are granularly cured.

When the reciprocation of the carriage 4 in the main scanning direction S finishes, it is determined whether or not the Y bar 3 has been transported a predetermined number of times in the sub-scanning direction F (step S3). Here, in the matte quality mode, printing data is divided into a plurality of bands and is recorded while the Y bar 3 is sequentially transported in the sub-scanning direction F. In addition, since recording of two passes is performed using the color inks through initial two scannings and recording of two passes is performed using the clear inks through subsequent two scannings in each band, recording in each band is completed through four scannings. For this reason, the determination that the Y bar 3 has been transported a predetermined number of times in the sub-scanning direction F in step S3 is performed after the fourth scanning, and, in the matte quality mode, a predetermined number of times for which the Y bar 3 is transported in the sub-scanning direction F is the division number of printing data +3.

In addition, since the current scanning is the first scanning, it is determined that the Y bar 3 has not been transported a predetermined number of times in the sub-scanning direction F (step S3: NO), the Y bar 3 is transported by one band (pass width) in the sub-scanning direction F (step S4), and the flow returns to step S1. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the second scanning, during forward movement of the carriage 4 in the main scanning direction S, ink droplets of color inks are ejected from the first ejection area A1-*a*, and the UVLEDs 63*a* and 63*b* disposed in the area B1 of the ultraviolet-ray irradiation device 6*b* are turned on, and ink droplets of color inks are ejected from the first ejection area A1-*b*, and the UVLEDs 63*c* and 63*d* disposed in the area B2 of the ultraviolet-ray irradiation device 6*b* are turned on (step S1). In addition, during the return movement of the carriage 4 in the opposite direction to the main scanning direction S, UVLEDs 63 which irradiate the band recorded in step S1 with ultraviolet rays are turned on (step S2). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the second pass recording is performed using the color inks ejected from the first ejection area A1-*b* in the band in which the first pass recording has been performed using the color inks ejected from the first ejection area A1-*a* in the first scanning, and the color inks are irradiated with ultraviolet rays immediately after being landed on the medium M and are granularly cured. Thus, recording of an image using the color inks in the corresponding band is completed. Further, in the second scanning, in the same manner as in the first scanning, the first pass recording is performed using the color inks ejected from the first ejection area A1-*a*.

When the reciprocation of the carriage 4 in the main scanning direction S finishes, since the current scanning is the second scanning (step S3: NO), the Y bar 3 is transported by one band (pass width) in the sub-scanning direction F (step S4), and the flow returns to step S1. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the third scanning, during forward movement of the carriage 4 in the main scanning direction S, ink droplets of color inks are ejected from the first ejection areas A1-*a* and A1-*b*, and the UVLEDs 63*a* to 63*d* disposed in the areas B1 and B2 of the ultraviolet-ray irradiation device 6*b* are turned on; and ink droplets of clear inks are ejected from the second ejection area A2-*a*, and the UVLEDs 63*e* and 63*f* disposed in the area B3 of the ultraviolet-ray irradiation device 6*b* are turned on (step S1). In addition, during the return movement of the carriage 4 in the opposite direction to the main scanning direction S, UVLEDs 63 which irradiate the band recorded in step S1 with ultraviolet rays are turned on (step S2). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the third pass recording is performed using the clear inks ejected from the second ejection area A2-*a* in the band in which the second pass recording has been performed using the color inks ejected from the first ejection area A1-*b* in the second scanning, and the clear inks are irradiated with ultraviolet rays immediately after being landed on the medium M and are granularly cured. Thus, coating of the first layer is performed on the image using the clear inks. Further, in the third scanning, in the same manner as in the first scanning, the first pass recording is performed using the color inks ejected from the first ejection area A1-*a*, and, in the same manner as in the second scanning, the second pass recording is performed using the color inks ejected from the first ejection area A1-*b*.

When the reciprocation of the carriage 4 in the main scanning direction S finishes, since the current scanning is the third scanning (step S3: NO), the Y bar 3 is transported by one band (pass width) in the sub-scanning direction F (step S4), and the flow returns to step S1. Then, since the carriage 4 mounted on the Y bar 3 is also moved by one band (pass width) in the sub-scanning direction F, the ink jet heads 5 and the ultraviolet-ray irradiation devices 6 can be correlated with the next pass line, and a recording position for the medium proceeds to the front side in the sub-scanning direction F.

In the fourth scanning, during forward movement of the carriage 4 in the main scanning direction S, ink droplets of color inks are ejected from the first ejection areas A1-*a* and A1-*b*, and the UVLEDs 63*a* to 63*d* disposed in the areas B1 and B2 of the ultraviolet-ray irradiation device 6*b* are turned on; ink droplets of clear inks are ejected from the second ejection area A2-*a*, and the UVLEDs 63*e* and 63*f* disposed in the area B3 of the ultraviolet-ray irradiation device 6*b* are turned on; and ink droplets of clear inks are ejected from the second ejection area A2-*b*, and the UVLEDs 63*g* and 63*h* disposed in the area B4 of the ultraviolet-ray irradiation device 6*b* are turned on (step S1). In addition, during the return movement of the carriage 4 in the opposite direction to the main scanning direction S, UVLEDs 63 which irradiate the band recorded in step S1 with ultraviolet rays are turned on (step S2). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the fourth pass recording is performed using the clear inks ejected from the second ejection area A2-*b* in the band in which the third pass recording has been performed using the clear inks ejected from the second ejection area A2-*a* in the previous scanning, and the clear inks are irradiated with ultraviolet rays immediately after being landed on the medium M and are granularly cured. Thus, coating of the second layer is performed on the image using the clear inks, and the overall recording (ejection of the ultraviolet-ray curable inks and curing of the ultraviolet-ray curable inks through irradiation with ultraviolet rays) finishes in the corresponding band. Further, in the fourth scanning, in the same manner as in the first scanning, the first pass recording is performed using the color inks ejected from the first ejection area A1-*a*; in the same manner as in the second scanning, the second pass recording is performed using the color inks ejected from the first ejection area A1-*b*; and, in the same manner as in the third scanning, the third pass recording is performed using the clear inks ejected from the second ejection area A2-*a*.

When the reciprocation of the carriage 4 in the main scanning direction S finishes, since the current scanning is the fourth scanning, it is then determined whether or not the Y bar 3 is transported a predetermined number of times in the sub-scanning direction F (step S3).

In addition, if it is determined that the Y bar 3 has not been transported a predetermined number of times in the sub-scanning direction F (step S3: NO), the Y bar 3 is transported by one band (pass width) in the sub-scanning direction F (step S4), and the flow returns to step S1. Then, since the carriage 4 is moved by one band in the sub-scanning direction F, the ink jet heads 5 and the ultraviolet-ray irradiation devices 6 can be correlated with the next pass line, and a recording position for the medium proceeds to the front side in the sub-scanning direction F. Further, the above-described steps S1 to S3 are repeatedly performed until it is determined that the Y bar 3 has been transported a predetermined number of times in the sub-scanning direction F in step S3.

On the other hand, if it is determined that the Y bar 3 has been transported a predetermined number of times in the sub-scanning direction F (step S3: YES), the printing process in the matte quality mode finishes.

Therefore, since the clear inks with uneven surfaces are recorded on the upper layer of an image recorded on the medium M, the image can be matted while securing visibility of the image.

[Gloss Quality Mode]

Figure 12:
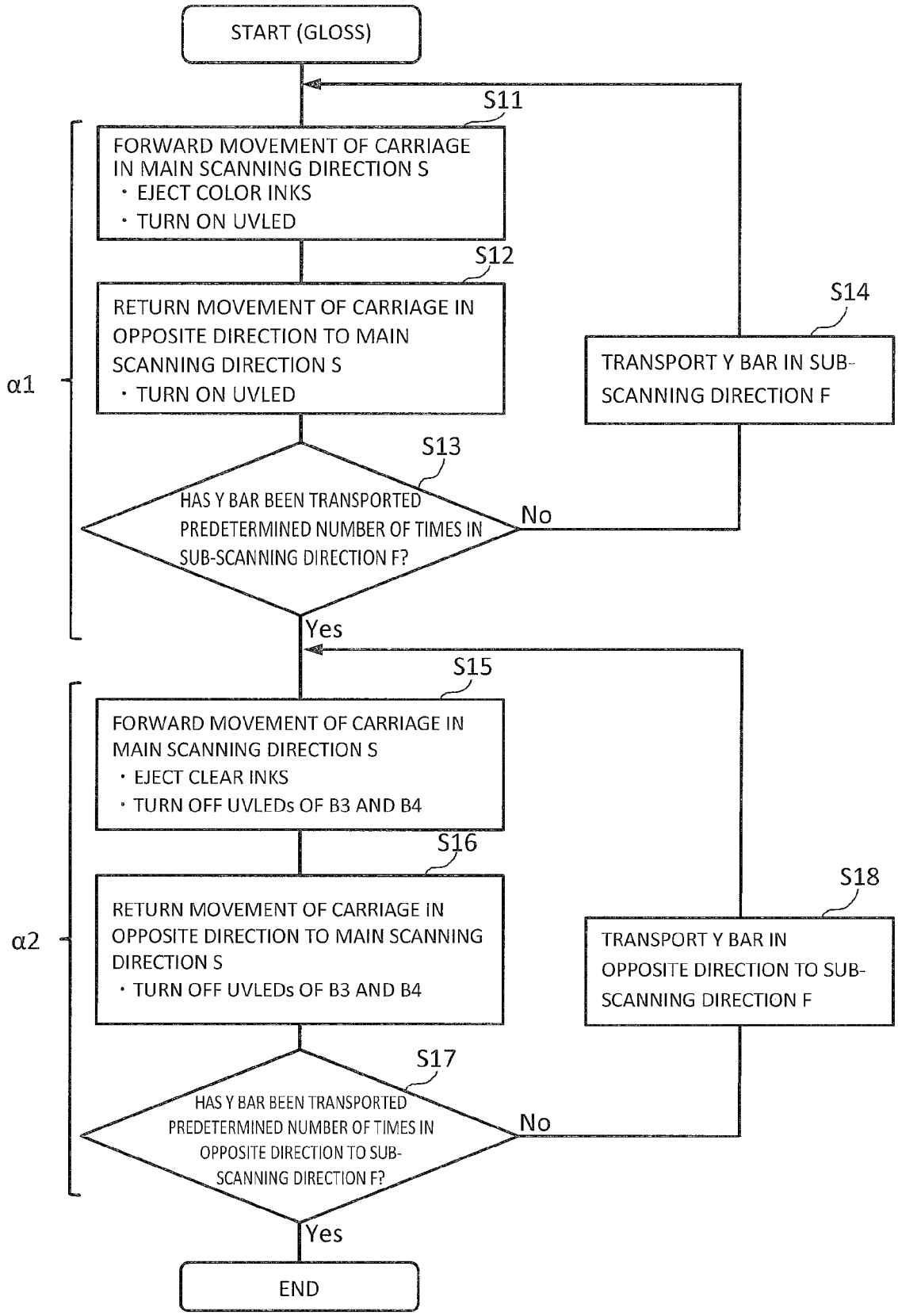
FIG. 12 is a flowchart illustrating a printing process method in a gloss quality mode.
Figure 13A:
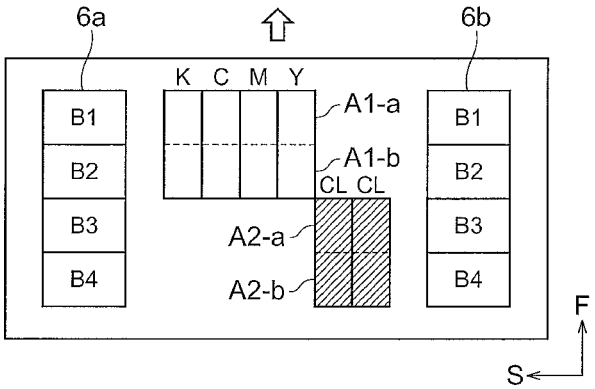
FIGS. 13A and 13B are conceptual diagrams illustrating an operation aspect example of the carriage in the gloss quality mode.
Figure 13B:
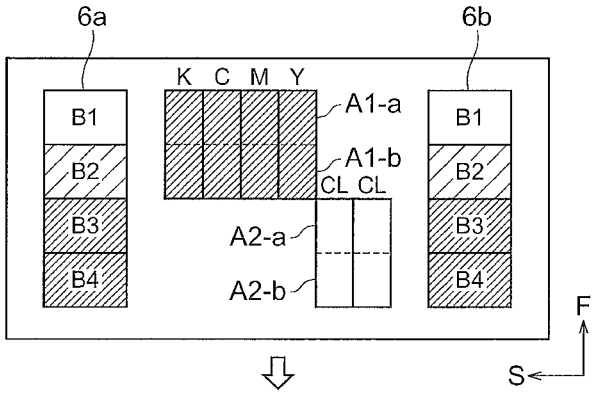

With reference to FIGS. 12, 13A and 13B, a description will be made of a printing process method in a gloss quality mode. FIG. 12 is a flowchart illustrating a printing process method in the gloss quality mode. FIGS. 13A and 13B are conceptual diagrams illustrating an operation aspect example of the carriage in the gloss quality mode. In FIGS. 13A and 13B, the thick arrow indicates a movement direction of the Y bar 3 in the sub-scanning direction F. In other words, FIG. 13A shows that the Y bar 3 moves in the sub-scanning direction F, and FIG. 13B shows that the Y bar 3 moves in the opposite direction to the sub-scanning direction F. In addition, in the gloss quality mode, it is assumed that ultraviolet-ray curable inks are ejected only during forward movement of the carriage 4 in the main scanning direction S, and the ultraviolet-ray curable inks are not ejected during the return movement of the carriage 4 in an opposite direction to the main scanning direction S.

As shown in FIGS. 12, 13A and 13B, in the gloss quality mode, first, in steps S11 to S14, the Y bar 3 is sequentially transported in the sub-scanning direction F so as to record an image using color inks, and, then, in steps S15 to S18, the Y bar 3 is sequentially transported in the opposite direction to the sub-scanning direction F so as to coat the image using clear inks. In other words, in the gloss quality mode, an image is recorded using color inks in a forward path of the Y bar 3 transported in the sub-scanning direction F, and the image is coated using clear inks in a return path of the Y bar 3 transported in the opposite direction to the sub-scanning direction F. For this reason, steps S11 to S14 are referred to as image recording steps α1, and an operation aspect example of the carriage in the image recording steps α1 is shown in FIG. 13A. In addition, steps S15 to S18 are referred to as coating steps α2, and an operation aspect example of the carriage in the coating steps α2 is shown in FIG. 13B.

Hereinafter, a printing process method in the gloss quality mode will be described in detail.

First, the medium M is placed on the flat bed 2, and the Y bar 3 is set at a rear end part (printing start position) in the sub-scanning direction F in a recording area of the medium M, and the image recording steps α1 are performed while sequentially transporting the Y bar 3 in the sub-scanning direction F.

As shown in FIG. 13A, in the first scanning of the image recording steps α1, ink droplets of color inks are ejected from the first ejection area A1-*a*, and the UVLEDs 63*a* and 63*b* disposed in the area B1 of the ultraviolet-ray irradiation device 6*b* are turned on during forward movement of the carriage 4 in the main scanning direction S (step S11). In addition, during the return movement of the carriage 4 in the opposite direction to the main scanning direction S, UVLEDs 63 which irradiate the band recorded in step S11 with ultraviolet rays are turned on (step S12). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the first pass recording is performed using the color inks ejected from the first ejection area A1-*a*, and the color inks are irradiated with ultraviolet rays immediately after being landed on the medium M and are granularly cured.

When the reciprocation of the carriage 4 in the main scanning direction S finishes, it is determined whether or not the Y bar 3 has been transported a predetermined number of times in the sub-scanning direction F (step S13). Here, in the image recording steps α1, printing data is divided into a plurality of bands and is recorded while the Y bar 3 is sequentially transported in the sub-scanning direction F. In addition, since recording of two passes using the color inks and irradiation of ultraviolet rays are performed through initial two scannings and irradiation of ultraviolet rays is also performed through subsequent two scannings in each band, recording in each band is completed through four scannings (four passes). For this reason, the determination that the Y bar 3 has been transported a predetermined number of times in the sub-scanning direction F in step S13 is performed after the fourth scanning, and a predetermined number of times for which the Y bar 3 is transported in the sub-scanning direction F in the image recording steps α1 is the division number of printing data +3.

In addition, since the current scanning is the first scanning of the image recording steps α1, it is determined that the Y bar 3 has not been transported a predetermined number of times in the sub-scanning direction F (step S13: NO), the Y bar 3 is transported by one band (pass width) in the sub-scanning direction F (step S14), and the flow returns to step S11. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the second scanning of the image recording steps α1, during forward movement of the carriage 4 in the main scanning direction S, ink droplets of color inks are ejected from the first ejection area A1-*a*, and the UVLEDs 63*a* and 63*b* disposed in the area B1 of the ultraviolet-ray irradiation device 6*b* are turned on, and ink droplets of color inks are ejected from the first ejection area A1-*b*, and the UVLEDs 63*c* and 63*d* disposed in the area B2 of the ultraviolet-ray irradiation device 6*b* are turned on (step S11). In addition, during the return movement of the carriage 4 in the opposite direction to the main scanning direction S, UVLEDs 63 which irradiate the band recorded in step S11 with ultraviolet rays are turned on (step S12). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the second pass recording is performed using the color inks ejected from the first ejection area A1-*b* in the band in which the first pass recording has been performed using the color inks ejected from the first ejection area A1-*a* in the previous scanning, and the color inks are irradiated with ultraviolet rays immediately after being landed on the medium M and are granularly cured. Thus, the overall recording (ejection of the color inks and curing of the color inks through irradiation with ultraviolet rays) using the color inks in the corresponding band is completed. Further, in the second scanning, in the same manner as in the first scanning, the first pass recording is performed using the color inks ejected from the first ejection area A1-*a*.

In addition, since the current scanning is the second scanning of the image recording steps α1, it is determined that the Y bar 3 has not been transported a predetermined number of times in the sub-scanning direction F (step S13: NO), the Y bar 3 is transported by one band (pass width) in the sub-scanning direction F (step S14), and the flow returns to step S11. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the third scanning of the image recording steps α1, during forward movement of the carriage 4 in the main scanning direction S, ink droplets of color inks are ejected from the first ejection areas A1-*a* and A1-*b*, and the UVLEDs 63*a* to 63*d* disposed in the areas B1 and B2 of the ultraviolet-ray irradiation device 6*b* are turned on; and the UVLEDs 63*e* and 63*f* disposed in the area B3 are turned on (step S11). In addition, during the return movement of the carriage 4 in the opposite direction to the main scanning direction S, UVLEDs 63 which irradiate the band recorded in step S11 with ultraviolet rays and the UVLEDs 63*e* and 63*f* disposed in the area B3 are turned on (step S12). Then, in the third pass, ultraviolet rays are applied from the UVLEDs 63*e* and 63*f* disposed in the area B3 to the band in which the second pass recording has been performed using the color inks ejected from the first ejection area A1-*b* in the previous scanning, and thus the color inks recorded in the corresponding band are further cured. Further, in the third scanning, in the same manner as in the first scanning, the first pass recording is performed using the color inks ejected from the first ejection area A1-*a*, and, in the same manner as in the second scanning, the second pass recording is performed using the color inks ejected from the first ejection area A1-*b*.

In addition, since the current scanning is the third scanning of the image recording steps α1, it is determined that the Y bar 3 has not been transported a predetermined number of times m in the sub-scanning direction F (step S13: NO), the Y bar 3 is transported by one band (pass width) in the sub-scanning direction F (step S14), and the flow returns to step S11. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the fourth scanning of the image recording steps α1, during forward movement of the carriage 4 in the main scanning direction S, ink droplets of color inks are ejected from the first ejection areas A1-*a* and A1-*b*, and the UVLEDs 63*a* to 63*d* disposed in the areas B1 and B2 of the ultraviolet-ray irradiation device 6*b* are turned on; the UVLEDs 63*e* and 63*f* disposed in the area B3 are turned on; and the UVLEDs 63*g* and 63*h* disposed in the area B4 are turned on (step S11). In addition, during the return movement of the carriage 4 in the opposite direction to the main scanning direction S, UVLEDs 63 which irradiate the band recorded in step S11 with ultraviolet rays and the UVLEDs 63*e* to 63*h* disposed in the areas B3 and B4 are turned on (step S12). Then, in the fourth pass, ultraviolet rays are applied from the UVLEDs 63*g* and 63*h* disposed in the area B4 to the band in which has been irradiated with ultraviolet rays by the UVLEDs 63*e* and 63*f* disposed in the area B3 in the previous scanning, and thus the color inks recorded in the corresponding band are further cured. Further, in the fourth scanning, in the same manner as in the first scanning, the first pass recording is performed using the color inks ejected from the first ejection area A1-*a*; in the same manner as in the second scanning, the second pass recording is performed using the color inks ejected from the first ejection area A1-*b*; and, in the same manner as in the third scanning, ultraviolet rays are applied from the UVLEDs 63*e* and 63*f* disposed in the area B4 to the band in which the second pass recording has been performed.

When the reciprocation of the carriage 4 in the main scanning direction S finishes, since the current scanning is the fourth scanning of the image recording steps α1, it is then determined whether or not the Y bar 3 has been transported a predetermined number of times in the sub-scanning direction F (step S13).

In addition, if it is determined that the Y bar 3 has not been transported a predetermined number of times in the sub-scanning direction F (step S13: NO), the Y bar 3 is transported by one band (pass width) in the sub-scanning direction F (step S14), and the flow returns to step S11. Then, since the carriage 4 is moved by one band in the sub-scanning direction F, the ink jet heads 5 and the ultraviolet-ray irradiation devices 6 can be correlated with the next pass line, and a recording position for the medium proceeds to the front side in the sub-scanning direction F. Further, the above-described steps S11 to S13 are repeatedly performed until it is determined that the Y bar 3 has been transported a predetermined number of times in the sub-scanning direction F in step S13.

Here, a description will be made of a method of recording a final band through the image recording steps α1 when the final scanning is an m-th scanning.

In the (m−2)-th scanning which is two scannings earlier than the final scanning, during forward movement of the carriage 4 in the main scanning direction S, ejection of the color inks from the first ejection area A1-*a* stops, ink droplets of the color inks are ejected from the first ejection area A1-*b*, the UVLEDs 63*c* and 63*d* disposed in the area B2 of the ultraviolet-ray irradiation device 6*b* are turned on, and the UVLEDs 63*e* to 63*h* disposed in the areas B3 and B4 are turned on (step S11). In addition, during the return movement of the carriage 4 in the opposite direction to the main scanning direction S, UVLEDs 63 which irradiate the band recorded in step S11 with ultraviolet rays and the UVLEDs 63*e* to 63*h* disposed in the areas B3 and B4 are turned on (step S12). Then, the second pass recording is performed using the color inks ejected from the first ejection area A1-*a* in the final band in which the first pass recording has been performed using the color inks ejected from the first ejection area A1-*a* in the previous scanning. In addition, ultraviolet rays are applied from the UVLEDs 63*e* and 63*f* disposed in the area B3 to the band in which the second pass recording has been performed using the color inks ejected from the first ejection area A1-*b* in the previous scanning, and ultraviolet rays are applied from the UVLEDs 63*g* and 63*h* disposed in the area B4 to the band which has been irradiated with ultraviolet rays by the UVLEDs 63*e* and 63*f* disposed in the area B3.

In the (m−1)-th scanning which is one scanning earlier than the final scanning, during forward movement of the carriage 4 in the main scanning direction S, ejection of the color inks from the first ejection areas A1-*a* and A1-*b* stops, and the UVLEDs 63*e* to 63*h* disposed in the areas B3 and B4 are turned on (step S11). In addition, during the return movement of the carriage 4 in the opposite direction to the main scanning direction S, the UVLEDs 63*e* to 63*h* disposed in the areas B3 and B4 are turned on (step S12). Then, ultraviolet rays are applied from the UVLEDs 63*e* and 63*f* disposed in the area B3 to the band in which the second pass recording has been performed using the color inks ejected from the first ejection area A1-*b* in the previous scanning. In addition, ultraviolet rays are applied from the UVLEDs 63*g* and 63*h* disposed in the area B4 to the band which has been irradiated with ultraviolet rays by the UVLEDs 63*e* and 63*f* disposed in the area B3 in the previous scanning.

In the m-th scanning which is the final scanning, during forward movement of the carriage 4 in the main scanning direction S, ejection of the color inks from the first ejection areas A1-*a* and A1-*b* stops, the UVLEDs 63*e* and 63*f* disposed in the area B3 are turned off, and only the UVLEDs 63*g* and 63*h* disposed in the area B4 are turned on (step S11). In addition, during the return movement of the carriage 4 in the opposite direction to the main scanning direction S, only the UVLEDs 63*g* and 63*h* disposed in the area B4 are turned on (step S12). Then, ultraviolet rays are applied from the UVLEDs 63*g* and 63*h* disposed in the area B4 to the final band which has been irradiated with ultraviolet rays by the UVLEDs 63*e* and 63*f* disposed in the area B3 in the previous scanning.

Thus, the image recording steps α1 finish in a state in which the second ejection area A2-*b* is disposed in the pass line of the final band.

On the other hand, if it is determined that the Y bar 3 has been transported a predetermined number of times in the sub-scanning direction F (step S13: YES), the coating steps α2 are then performed while sequentially transporting the Y bar 3 in the opposite direction to the sub-scanning direction F.

As shown in FIG. 13B, in the first scanning of the coating steps α2, during forward movement of the carriage 4 in the main scanning direction S, ink droplets of clear inks are ejected from the second ejection area A2-*b*, and the UVLEDs 63*g* and 63*h* disposed in the area B4 of the ultraviolet-ray irradiation device 6*a* and the ultraviolet-ray irradiation device 6*b* are turned off (step S15). In addition, during the return movement of the carriage 4 in the opposite direction to the main scanning direction S, the UVLEDs 63*g* and 63*h* disposed in the band in which the clear inks are recorded in step S15 are turned off (step S16). At this time, the second ejection area A2-*b* is disposed in the pass line of the final band in the image recording steps α1. For this reason, the fifth pass recording is performed using clear inks ejected from the second ejection area A2-*b* in the band which is the final band in the image recording steps α1 and is disposed on the frontmost side in the sub-scanning direction F. At this time, since the UVLEDs 63*g* and 63*h* are turned off which are disposed in the area B4 and irradiate the band in which clear inks ejected from the second ejection area A2-*b* are recorded with ultraviolet rays, the clear inks in the fifth pass which have been landed on the medium M are not cured but gradually wettedly spread so as to decrease the thickness, and therefore the uneven surfaces thereof are smoothed out. In addition, in the first scanning, the UVLEDs 63*a* to 63*d* disposed in the areas B1 and B2 may be turned on or off.

When the reciprocation of the carriage 4 in the main scanning direction S finishes, it is determined whether or not the Y bar 3 has been transported a predetermined number of times in the opposite direction to the sub-scanning direction F (step S17). Here, in the coating steps α2, printing data is divided into a plurality of bands and is recorded while the Y bar 3 is sequentially transported in the opposite direction to the sub-scanning direction F. In addition, since recording of two passes is performed using the clear inks through initial two scannings and the clear inks recorded in each band are irradiated with ultraviolet rays through subsequent two scannings in each band, recording in each band is completed through four scannings (four passes). For this reason, the determination that the Y bar 3 has been transported a predetermined number of times in the opposite direction to the sub-scanning direction F in step S17 is performed after the fourth scanning, and a predetermined number of times for which the Y bar 3 is transported in the opposite direction to the sub-scanning direction F in the coating steps α2 is the division number of printing data +3.

In addition, since the current scanning is the first scanning of the coating steps α2, it is determined that the Y bar 3 has not been transported a predetermined number of times in the opposite direction to the sub-scanning direction F (step S17: NO), the Y bar 3 is transported by one band (pass width) in the opposite direction to the sub-scanning direction F (step S18), and the flow returns to step S15. Then, since the carriage 4 mounted on the Y bar 3 is also moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F.

In the second scanning of the coating steps α2, during forward movement of the carriage 4 in the main scanning direction S, ink droplets of clear inks are ejected from the second ejection area A2-*b*, and the UVLEDs 63*g* and 63*h* disposed in the area B4 of the ultraviolet-ray irradiation device 6*a* and the ultraviolet-ray irradiation device 6*b* are turned off; and ink droplets of clear inks are ejected from the second ejection area A2-*a*, and the UVLEDs 63*e* and 63*f* disposed in the area B3 of the ultraviolet-ray irradiation device 6*a* and the ultraviolet-ray irradiation device 6*b* are turned off (step S15). In addition, during the return movement of the carriage 4 in the opposite direction to the main scanning direction S, the UVLEDs 63*e* to 63*h* disposed in the band in which the clear inks are recorded in step S15 are turned off (step S16). Then, the sixth pass recording is performed using the clear inks ejected from the second ejection area A2-*a* in the band in which the fifth pass recording has been performed using clear inks ejected from the second ejection area A2-*b* in the first scanning. At this time, since the UVLEDs 63*e* and 63*f* are turned off which are disposed in the area B3 and irradiate the band in which clear inks ejected from the second ejection area A2-*a* are recorded with ultraviolet rays, the clear inks in the sixth pass which have been landed on the medium M are not cured but gradually wettedly spread so as to decrease the thickness along with the clear inks in the fifth pass, and therefore the uneven surfaces thereof are smoothed out. In addition, in the second scanning, in the same manner as in the first scanning, the fifth pass recording is performed using the clear inks ejected from the second ejection area A2-*b*. Further, in the second scanning, the UVLEDs 63*a* to 63*d* disposed in the areas B1 and B2 may be turned on or off.

When the reciprocation of the carriage 4 in the main scanning direction S finishes, since the current scanning is the second scanning of the coating steps α2 (step S17: NO), the Y bar 3 is transported by one band (pass width) in the opposite direction to the sub-scanning direction F (step S18), and the flow returns to step S15. Then, since the carriage 4 mounted on the Y bar 3 is also moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F.

In the third scanning of the coating steps α2, during forward movement of the carriage 4 in the main scanning direction S, ink droplets of clear inks are ejected from the second ejection areas A2-*a* and A2-*b*, and the UVLEDs 63*e* to 63*h* disposed in the areas B3 and B4 of the ultraviolet-ray irradiation device 6*a* and the ultraviolet-ray irradiation device 6*b* are turned off; and the UVLEDs 63*c* and 63*d* disposed in the area B2 are turned on (step S15). In addition, during the return movement of the carriage 4 in the opposite direction to the main scanning direction S, the UVLEDs 63*c* and 63*d* disposed in the area B2 are turned on (step S16). Further, the UVLEDs 63*c* and 63*d* to be turned on may be those of both of the ultraviolet-ray irradiation device 6*a* and the ultraviolet-ray irradiation device 6*b*, or may be those of either one. Then, in the seventh pass, ultraviolet rays are applied from the UVLEDs 63*c* and 63*d* disposed in the area B2 to the band in which the sixth pass recording was performed using the clear inks ejected from the second ejection area A2-*a* in the second scanning one scanning ago, and thus the clear inks in the fifth and sixth passes start to be cured in a state of being sufficiently smoothed. In addition, in the third scanning, in the same manner as in the first scanning, the fifth pass recording is performed using the clear inks ejected from the second ejection area A2-*b*, and, in the same manner as in the second scanning, the sixth pass recording is performed using the clear inks ejected from the second ejection area A2-*a*.

When the reciprocation of the carriage 4 in the main scanning direction S finishes, since the current scanning is the third scanning of the coating steps α2 (step S17: NO), the Y bar 3 is transported by one band (pass width) in the opposite direction to the sub-scanning direction F (step S18), and the flow returns to step S15. Then, since the carriage 4 mounted on the Y bar 3 is also moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F.

In the fourth scanning of the coating steps α2, during forward movement of the carriage 4 in the main scanning direction S, ink droplets of clear inks are ejected from the second ejection areas A2-*a* and A2-*b*, and the UVLEDs 63*e* to 63*h* disposed in the areas B3 and B4 of the ultraviolet-ray irradiation device 6*a* and the ultraviolet-ray irradiation device 6*b* are turned off; the UVLEDs 63*c* and 63*d* disposed in the area B2 are turned on; and the UVLEDs 63*a* and 63*b* disposed in the area B1 are turned on (step S15). In addition, during the return movement of the carriage 4 in the opposite direction to the main scanning direction S, the UVLEDs 63*a* to 63*d* disposed in the areas B1 and B2 are turned on (step S16). Further, the UVLEDs 63*a* to 63*d* to be turned on may be those of both of the ultraviolet-ray irradiation device 6*a* and the ultraviolet-ray irradiation device 6*b*, or may be those of either one. Then, in the eighth pass, ultraviolet rays are applied from the UVLEDs 63*a* and 63*b* disposed in the area B1 to the band which was irradiated with ultraviolet rays by the UVLEDs 63*c* and 63*d* disposed in the area B2 in the third scanning one scanning ago, such that curing of the clear inks is sufficiently promoted. In addition, in the fourth scanning, in the same manner as in the first scanning, the fifth pass recording is performed using the clear inks ejected from the second ejection area A2-*b*; in the same manner as in the second scanning, the sixth pass recording is performed using the clear inks ejected from the second ejection area A2-*a*; and, in the same manner as in the third scanning, ultraviolet rays are applied to the band in which the sixth pass recording was performed one scanning ago.

When the reciprocation of the carriage 4 in the main scanning direction S finishes in this way, since the current scanning is the fourth scanning of the coating steps α2, it is then determined whether or not the Y bar 3 has been transported a predetermined number of times in the opposite direction to the sub-scanning direction F (step S17).

In addition, if it is determined that the Y bar 3 has not been transported a predetermined number of times in the opposite direction to the sub-scanning direction F (step S17: NO), the Y bar 3 is transported by one band (pass width) in the opposite direction to the sub-scanning direction F (step S18), and the flow returns to step S15. Then, since the carriage 4 mounted is moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F. Further, the above-described steps S15 to S17 are repeatedly performed until it is determined that the Y bar 3 has been transported a predetermined number of times in the opposite direction to the sub-scanning direction F in step S17.

On the other hand, if it is determined that the Y bar 3 has been transported a predetermined number of times in the opposite direction to the sub-scanning direction F (step S17: YES), the printing process in the gloss quality mode finishes.

Therefore, since the smoothed clear inks are recorded on the upper layer of an image recorded on the medium M, it is possible to secure visibility of the image and to give glossiness to the image.

Figure 14B:
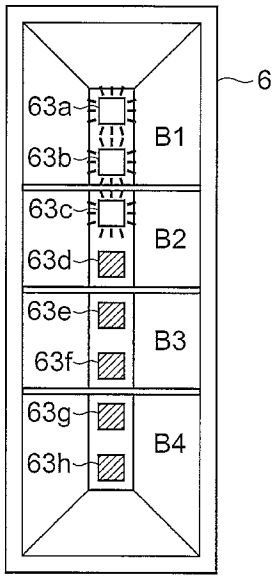
FIGS. 14A and 14B are diagrams illustrating a turning-on control example of UVLEDs.
Figure 14A:
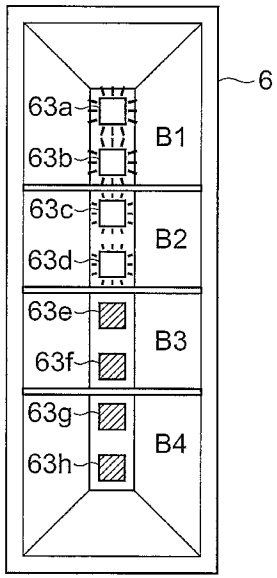

In addition, in steps S15 and S16, an amount of light emitted from the UVLEDs 63 (the UVLEDs 63*c* and 63*d*) disposed in the area B2 is preferably smaller than an amount of light emitted from the UVLEDs (the UVLEDs 63*a* and 63*b*) disposed in the area B1. This light amount control of ultraviolet rays can be realized by individually controlling turning-on of each UVLED 63. For example, as shown in FIG. 14A, the control may be realized by decreasing a current applied to the UVLEDs 63*c* and 63*d* so as to reduce a light amount itself of the UVLEDs 63*c* and 63*d*. In addition, as shown in FIG. 14B, the control may be realized by turning on the UVLED 63*c* in the same manner as the UVLEDs 63*a* and 63*b* and by turning off the UVLED 63*d*. In addition, in a case of an ink with very favorable curability, only the UVLEDs 63*a* and 63*b* may be turned on.

Since an initial light amount of ultraviolet rays applied to clear inks is reduced and a light amount of ultraviolet rays applied to the clear inks can be increased in stages by performing the turning-on control of the UVLEDs 63 in this way, it is possible to prevent the occurrence of bending due to rapid curing of clear inks and to reliably cure the clear inks. In addition, since curing speed of clear inks which directly overlap color inks is reduced, it is possible to improve adhesiveness of the color inks and clear inks.

Figure 15A:
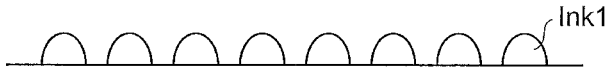
FIGS. 15A to 15C are diagrams illustrating a state of ink droplets landed on a medium.
Figure 15B:
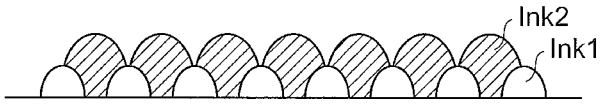
Figure 15C:
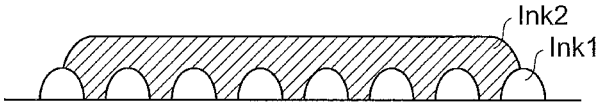

Here, with reference to FIGS. 15A to 15C, a description will be made of a curing state of clear inks. FIGS. 15A to 15C are diagrams illustrating states of ink droplets landed on a medium. As described above, in the image recording steps α1, ink droplets of color inks are cured immediately after being landed on the medium M, and, thus, as shown in FIG. 15A, the color inks Ink1 are granularly cured. Thereafter, in the coating steps α2, since ink droplets of clear inks are not immediately cured even if the ink droplets are landed on the medium M, as shown in FIGS. 15B and 15C, the clear inks Ink2 are pervaded between the granularly cured color inks Ink1, are combined with the adjacent ink droplets, and wettedly spread so as to decrease the thickness, thereby smoothing out the uneven surface. In addition, if the underlying color inks have a planar shape, movement of the overlying clear inks are not activated, and thus speed at which the clear inks are smoothed is reduced; however, as above, since the underlying color inks are granularly cured, movement of the overlying clear inks are activated, and thus it is possible to increase speed at which the clear inks are smoothed. Further, the clear inks Ink2 are cured after being sufficiently smoothed, and thus it is possible to obtain an image with gloss image quality.

In addition, in steps S15 and S16, a dust removal step is preferably performed using the above-described dust removal means (the dust removal means and the dust removal operation have been described). According thereto, it is possible to prevent dust from being attached to surfaces of ink droplets of clear inks until the clear inks are irradiated with ultraviolet rays and are cured after the clear inks are ejected onto the medium M. In other words, since image quality of glossy printing is prevented from deteriorating, it is possible to realize high gloss image quality with sufficient glossiness.

[Single Layer Gloss Quality Mode]

Figure 16:
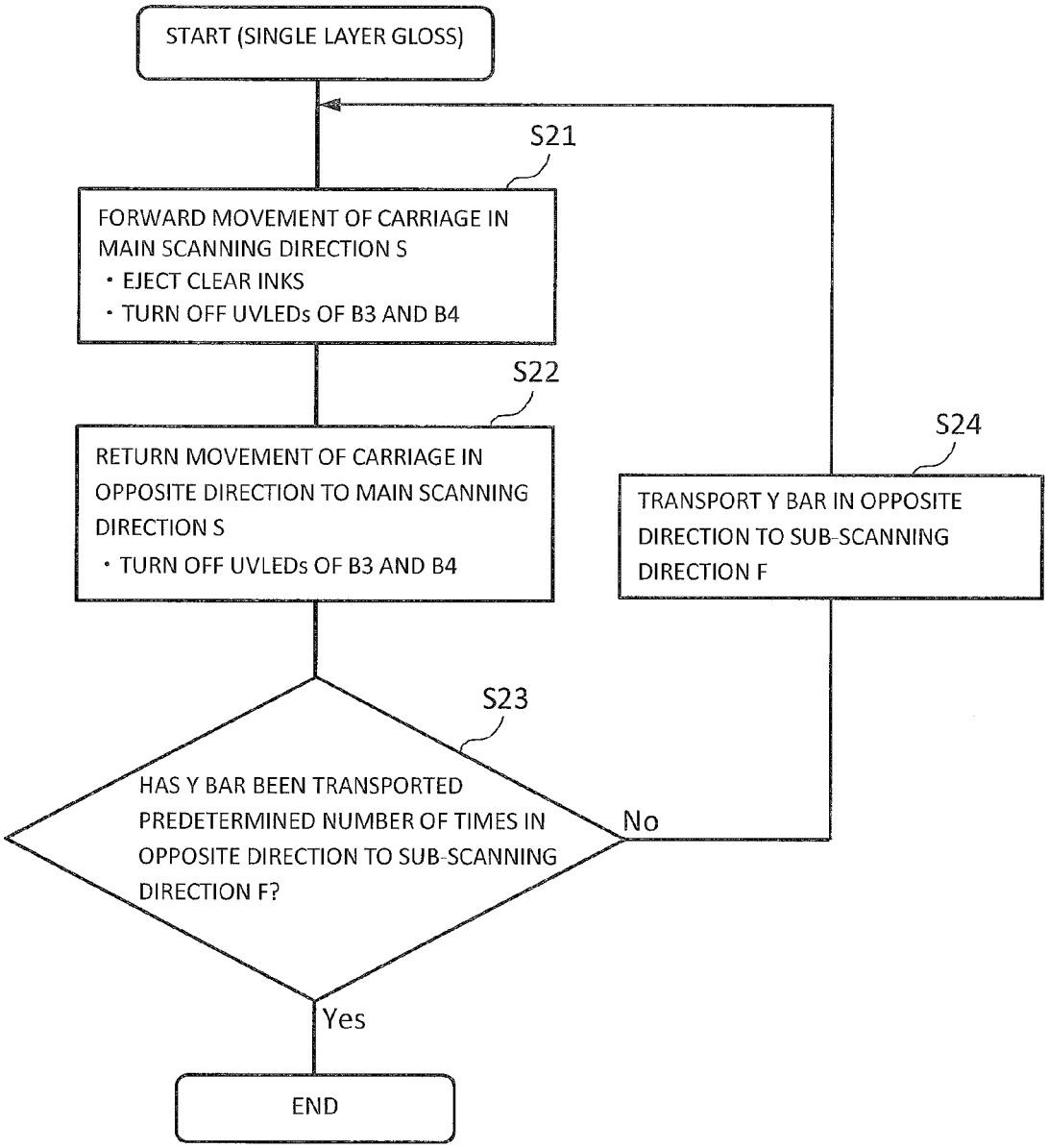
FIG. 16 is a flowchart illustrating a printing process method in a single layer gloss quality mode.
Figure 17:
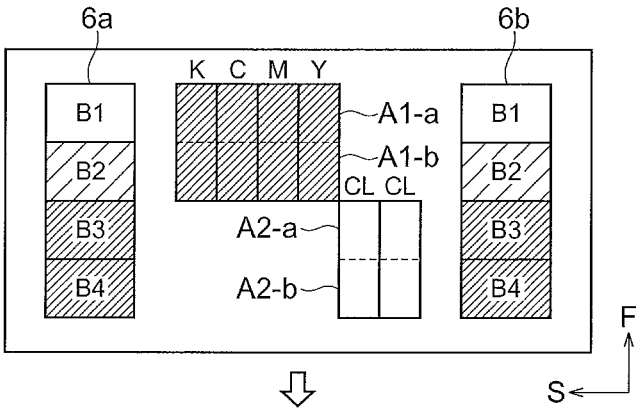
FIG. 17 is a conceptual diagram illustrating an operation aspect example of the carriage in the single layer gloss quality mode.

With reference to FIGS. 16 and 17, a description will be made of a printing process method in a single layer gloss quality mode. FIG. 16 is a flowchart illustrating a printing process method in the single layer gloss quality mode. FIG. 17 is a conceptual diagram illustrating an operation aspect example of the carriage in the single layer gloss quality mode. In FIG. 17, the thick arrow indicates a movement direction of the Y bar 3 in the sub-scanning direction F. In other words, FIG. 17 shows that the Y bar 3 moves in the opposite direction to the sub-scanning direction F. In addition, in the single layer gloss quality mode, it is assumed that ultraviolet-ray curable inks are ejected only during forward movement of the carriage 4 in the main scanning direction S, and the ultraviolet-ray curable inks are not ejected during the return movement of the carriage 4 in an opposite direction to the main scanning direction S.

As shown in FIGS. 16 and 17, in the single layer gloss quality mode, since the Y bar 3 is transported in the opposite direction to the sub-scanning direction F so as to perform only gloss quality recording, first, the medium M on which an image is formed is placed on the flat bed 2, and the Y bar 3 is set at a front end part (printing start position) in the sub-scanning direction F in a recording area of the medium M.

As shown in FIG. 17, ink droplets of clear inks are ejected from the second ejection area A2-*b*, and the UVLEDs 63*g* and 63*h* disposed in the area B4 of the ultraviolet-ray irradiation device 6*a* and the ultraviolet-ray irradiation device 6*b* are turned off in the first scanning of the single layer gloss quality mode during forward movement of the carriage 4 in the main scanning direction S (step S21). In addition, during the return movement of the carriage 4 in the opposite direction to the main scanning direction S, UVLEDs 63*g* and 63*h* disposed in the band in which the clear inks are recorded in step S21 are turned off (step S22). Then, the first pass recording is performed using the clear inks ejected from the second ejection area A2-*b* in the band disposed on the frontmost side in the sub-scanning direction F. At this time, since the UVLEDs 63*g* and 63*h* are turned off which are disposed in the area B4 and irradiate the band in which clear inks ejected from the second ejection area A2-*b* are recorded with ultraviolet rays, the clear inks in the first pass which have been landed on the medium M are not cured but gradually wettedly spread so as to decrease the thickness, and therefore the uneven surfaces thereof are smoothed out. In addition, in the first scanning, the UVLEDs 63*a* to 63*d* disposed in the areas B1 and B2 may be turned on or off.

When the reciprocation of the carriage 4 in the main scanning direction S finishes, it is determined whether or not the Y bar 3 has been transported a predetermined number of times in the opposite direction to the sub-scanning direction F (step S23). Here, in the single layer gloss quality mode, printing data is divided into a plurality of bands and is recorded while the Y bar 3 is sequentially transported in the opposite direction to the sub-scanning direction F. In addition, since recording of two passes using the clear inks is performed through initial two scannings and the clear inks recorded in each band are irradiated with ultraviolet rays through subsequent two scannings in each band, recording in each band is completed through four scannings (four passes). For this reason, the determination that the Y bar 3 has been transported a predetermined number of times in the opposite direction to the sub-scanning direction F in step S23 is performed after the fourth scanning, and a predetermined number of times for which the Y bar 3 is transported in the opposite direction to the sub-scanning direction F in the single layer gloss quality mode is the division number of printing data +3.

In addition, since the current scanning is the first scanning of the single layer gloss quality mode, it is determined that the Y bar 3 has not been transported a predetermined number of times in the opposite direction to the sub-scanning direction F (step S23: NO), the Y bar 3 is transported by one band (pass width) in the opposite direction to the sub-scanning direction F (step S24), and the flow returns to step S21. Then, since the carriage 4 mounted on the Y bar 3 is also moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F.

In the second scanning of the single layer gloss quality mode, during forward movement of the carriage 4 in the main scanning direction S, ink droplets of clear inks are ejected from the second ejection area A2-*b*, and the UVLEDs 63*g* and 63*h* disposed in the area B4 of the ultraviolet-ray irradiation device 6*a* and the ultraviolet-ray irradiation device 6*b* are turned off; and ink droplets of clear inks are ejected from the second ejection area A2-*a*, and the UVLEDs 63*e* and 63*f* disposed in the area B3 of the ultraviolet-ray irradiation device 6*a* and the ultraviolet-ray irradiation device 6*b* are turned off (step S21). In addition, during the return movement of the carriage 4 in the opposite direction to the main scanning direction S, the UVLEDs 63*e* to 63*h* disposed in the band in which the clear inks has been recorded in step S21 are turned off (step S22). Then, the second pass recording is performed using the clear inks ejected from the second ejection area A2-*a* in the band in which the first pass recording has been performed using clear inks ejected from the second ejection area A2-*b* in the first scanning. At this time, since the UVLEDs 63*e* and 63*f* are turned off which are disposed in the area B3 and irradiate the band in which clear inks ejected from the second ejection area A2-*b* are recorded with ultraviolet rays, the clear inks in the second pass which have been landed on the medium M are not cured but gradually wettedly spread so as to decrease the thickness along with the clear inks in the first pass, and therefore the uneven surfaces thereof are smoothed out. In addition, in the second scanning, in the same manner as in the first scanning, the first pass recording is performed using the clear inks ejected from the second ejection area A2-*b*. Further, in the second scanning, the UVLEDs 63 disposed in the areas B1 and B2 may be turned on or off.

When the reciprocation of the carriage 4 in the main scanning direction S finishes, since the current scanning is the second scanning of the single layer gloss quality mode (step S23: NO), the Y bar 3 is transported by one band (pass width) in the opposite direction to the sub-scanning direction F (step S24), and the flow returns to step S21. Then, since the carriage 4 mounted on the Y bar 3 is also moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F.

In the third scanning of the single layer gloss quality mode, during forward movement of the carriage 4 in the main scanning direction S, ink droplets of clear inks are ejected from the second ejection areas A2-*a* and A2-*b*, and the UVLEDs 63*e* to 63*h* disposed in the areas B3 and B4 of the ultraviolet-ray irradiation device 6*a* and the ultraviolet-ray irradiation device 6*b* are turned off; and the UVLEDs 63*c* and 63*d* disposed in the area B2 are turned on (step S21). In addition, during the return movement of the carriage 4 in the opposite direction to the main scanning direction S, the UVLEDs 63*c* and 63*d* disposed in the area B2 are turned on (step S16). Further, the UVLEDs 63*c* and 63*d* to be turned on may be those of both of the ultraviolet-ray irradiation device 6*a* and the ultraviolet-ray irradiation device 6*b*, or may be those of either one. Then, in the third pass, ultraviolet rays are applied from the UVLEDs 63*c* and 63*d* disposed in the area B2 to the band in which the second pass recording was performed using the clear inks ejected from the second ejection area A2-*a* in the second scanning one scanning ago, and thus the clear inks in the first and second passes start to be cured in a state of being sufficiently smoothed. In addition, in the third scanning, in the same manner as in the first scanning, the first pass recording is performed using the clear inks ejected from the second ejection area A2-*b*, and, in the same manner as in the second scanning, the second pass recording is performed using the clear inks ejected from the second ejection area A2-*a*.

When the reciprocation of the carriage 4 in the main scanning direction S finishes, since the current scanning is the third scanning of the single layer gloss quality mode (step S23: NO), the Y bar 3 is transported by one band (pass width) in the opposite direction to the sub-scanning direction F (step S24), and the flow returns to step S21. Then, since the carriage 4 mounted on the Y bar 3 is also moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F.

In the fourth scanning of the single layer gloss quality mode, during forward movement of the carriage 4 in the main scanning direction S, ink droplets of clear inks are ejected from the second ejection areas A2-*a* and A2-*b*, and the UVLEDs 63*e* to 63*h* disposed in the areas B3 and B4 of the ultraviolet-ray irradiation device 6*a* and the ultraviolet-ray irradiation device 6*b* are turned off; the UVLEDs 63*c* and 63*d* disposed in the area B2 are turned on; and the UVLEDs 63*a* and 63*b* disposed in the area B1 are turned on (step S21). In addition, during the return movement of the carriage 4 in the opposite direction to the main scanning direction S, the UVLEDs 63*a* to 63*d* disposed in the areas B1 and B2 are turned on (step S22). Further, the UVLEDs 63*a* to 63*d* to be turned on may be those of both of the ultraviolet-ray irradiation device 6*a* and the ultraviolet-ray irradiation device 6*b*, or may be those of either one. Then, in the fourth pass, ultraviolet rays are applied from the UVLEDs 63*a* and 63*b* disposed in the area B1 to the band which was irradiated with ultraviolet rays by the UVLEDs 63*c* and 63*d* disposed in the area B2 in the third scanning one scanning ago, such that curing of the clear inks is sufficiently promoted. In addition, in the fourth scanning, in the same manner as in the first scanning, the first pass recording is performed using the clear inks ejected from the second ejection area A2-*b*; in the same manner as in the second scanning, the second pass recording is performed using the clear inks ejected from the second ejection area A2-*a*; and, in the same manner as in the third scanning, ultraviolet rays are applied to the band in which the second pass recording was performed one scanning ago.

When the reciprocation of the carriage 4 in the main scanning direction S finishes in this way, since the current scanning is the fourth scanning of the single layer gloss quality mode, it is then determined whether or not the Y bar 3 has been transported a predetermined number of times in the opposite direction to the sub-scanning direction F (step S23).

In addition, if it is determined that the Y bar 3 has not been transported a predetermined number of times in the opposite direction to the sub-scanning direction F (step S23: NO), the Y bar 3 is transported by one band (pass width) in the opposite direction to the sub-scanning direction F (step S24), and the flow returns to step S21. Then, since the carriage 4 is moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F. Further, the above-described steps S21 to S23 are repeatedly performed until it is determined that the Y bar 3 has been transported a predetermined number of times in the opposite direction to the sub-scanning direction F in step S23.

On the other hand, if the Y bar 3 has been transported a predetermined number of times in the sub-scanning direction F (step S23: YES), the printing process in the single layer gloss quality mode finishes.

Therefore, since the smoothed clear inks are recorded on the medium M on which an image is formed, it is possible to secure visibility of the image formed on the medium M and to give glossiness to the image.

In addition, in steps S21 and S22, a dust removal step is preferably performed using the above-described dust removal means (the dust removal means and the dust removal operation have been described). According thereto, it is possible to prevent dust from being attached to surfaces of ink droplets of clear inks until the clear inks are irradiated with ultraviolet rays and are cured after the clear inks are ejected onto the medium M. In other words, since image quality of glossy printing is prevented from deteriorating, it is possible to realize high gloss image quality with sufficient glossiness.

[Thickness Heaping Quality Mode]

Figure 18:
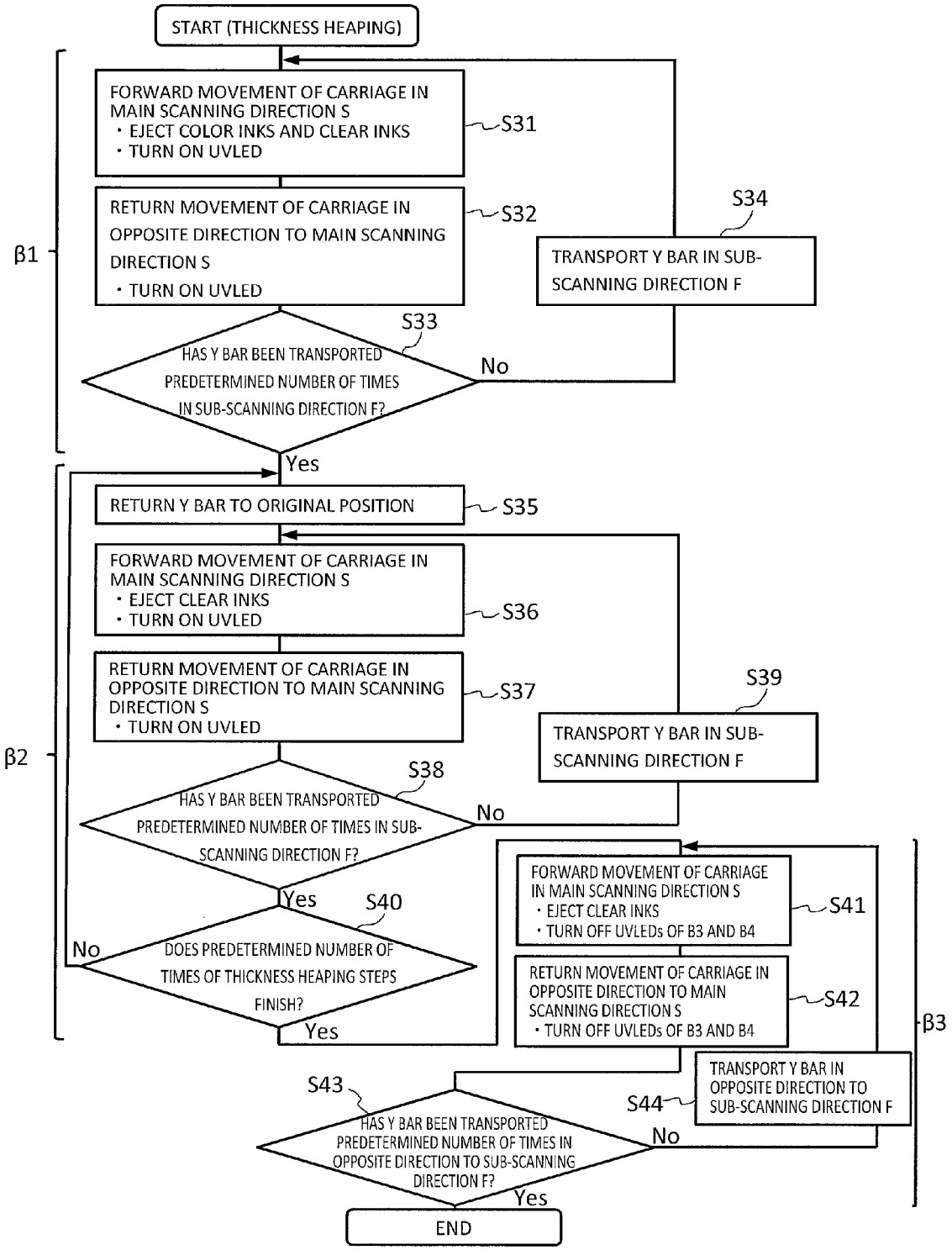
FIG. 18 is a flowchart illustrating a printing process method in a thickness heaping quality mode.
Figure 19A:
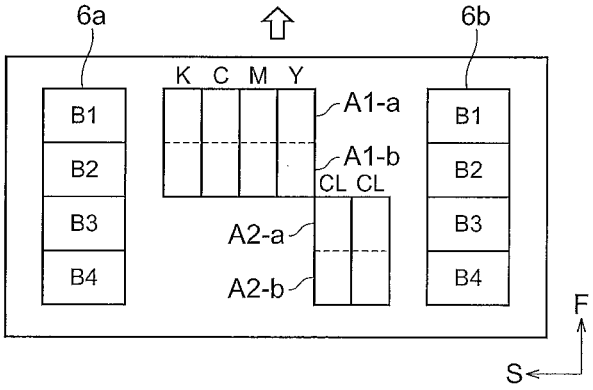
FIGS. 19A to 19C are conceptual diagrams illustrating an operation aspect example of the carriage in the thickness heaping quality mode.
Figure 19B:
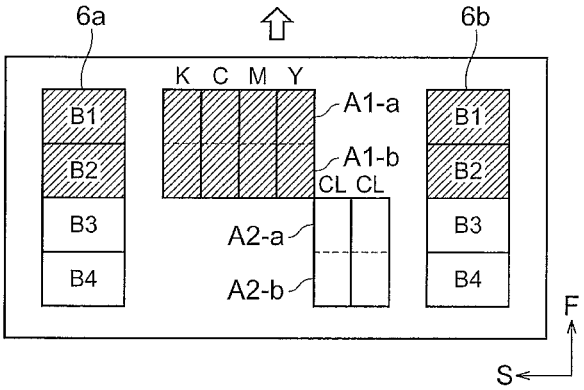
Figure 19C:
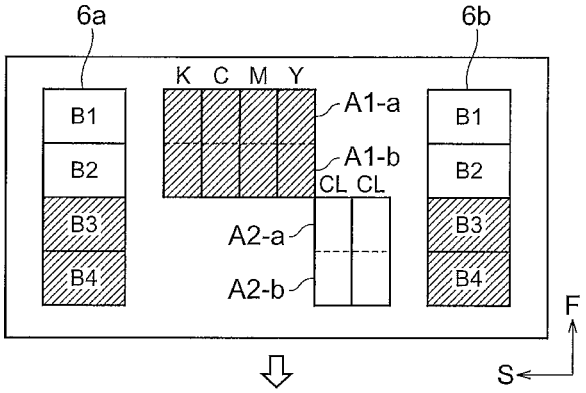

With reference to FIGS. 18 and 19A to 19C, a description will be made of a printing process method in a thickness heaping quality mode. FIG. 18 is a flowchart illustrating a printing process method in the thickness heaping quality mode. FIGS. 19A to 19C are conceptual diagrams illustrating an operation aspect example of the carriage in the thickness heaping quality mode. In FIGS. 19A to 19C, the thick arrow indicates a movement direction of the Y bar 3 in the sub-scanning direction F. In other words, FIG. 19A shows that the Y bar 3 moves in the sub-scanning direction F, FIG. 19B shows that the Y bar 3 moves in the sub-scanning direction F, and FIG. 19C shows that the Y bar 3 moves in the opposite direction to the sub-scanning direction F. In addition, in the thickness heaping quality mode, it is assumed that ultraviolet-ray curable inks are ejected only during forward movement of the carriage 4 in the main scanning direction S, and the ultraviolet-ray curable inks are not ejected during the return movement of the carriage 4 in an opposite direction to the main scanning direction S.

As shown in FIGS. 18, and 19A to 19C, first, in steps S31 to S34, the Y bar 3 is sequentially transported in the sub-scanning direction F so as to record an image using color inks and to coat the image using clear inks; next, in steps S35 to S40, the Y bar 3 is sequentially transported in the sub-scanning direction F so as to perform thickness heaping using clear inks; and, next, in steps S41 to S44, the Y bar 3 is sequentially transported in the opposite direction to the sub-scanning direction F so as to perform a gloss process using clear inks. For this reason, steps S31 to S34 are referred to as image recording and coating steps β1, and FIG. 19A shows an operation aspect example of the carriage in the image recording and coating steps β1. In addition, steps S35 to S40 are referred to as thickness heaping steps β2, and FIG. 19B shows an operation aspect example of the carriage in the thickness heaping steps β2. Further, steps S41 to S44 are referred to as gloss process steps, and FIG. 19C shows an operation aspect example of the carriage in the gloss process steps β3.

Hereinafter, a printing process method in the thickness heaping quality mode will be described in detail.

First, the medium M is placed on the flat bed 2, and the Y bar 3 is set at a rear end part (printing start position) in the sub-scanning direction F in a recording area of the medium M, and the image recording and the coating steps β1 are performed while sequentially transporting the Y bar 3 in the sub-scanning direction F.

As shown in FIG. 19A, in the first scanning of the image recording and coating steps β1, ink droplets of color inks are ejected from the first ejection area A1-*a*, and the UVLEDs 63*a* and 63*b* disposed in the area B1 of the ultraviolet-ray irradiation device 6*b* are turned on during forward movement of the carriage 4 in the main scanning direction S (step S31). In addition, during the return movement of the carriage 4 in the opposite direction to the main scanning direction S, UVLEDs 63 which irradiate the band recorded in step S31 with ultraviolet rays are turned on (step S32). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the first pass recording is performed using the color inks ejected from the first ejection area A1-*a*, and the color inks are irradiated with ultraviolet rays immediately after being landed on the medium M and are granularly cured.

When the reciprocation of the carriage 4 in the main scanning direction S finishes, it is determined whether or not the Y bar 3 has been transported a predetermined number of times in the sub-scanning direction F (step S33). Here, in the image recording and the coating steps β1, printing data is divided into a plurality of bands and is recorded while the Y bar 3 is sequentially transported in the sub-scanning direction F. In addition, since recording of two passes using the color inks is performed through initial two scannings and recording of two passes is performed using the clear inks through subsequent two scannings in each band, recording in each band is completed through a total of four scannings. For this reason, the determination that the Y bar 3 has been transported a predetermined number of times in the sub-scanning direction F in step S33 is performed after the fourth scanning, and a predetermined number of times for which the Y bar 3 is transported in the sub-scanning direction F in the image recording and the coating steps β1 is the division number of printing data +3.

In addition, since the current scanning is the first scanning of the image recording and the coating steps β1, it is determined that the Y bar 3 has not been transported a predetermined number of times in the sub-scanning direction F (step S33: NO), the Y bar 3 is transported by one band (pass width) in the sub-scanning direction F (step S34), and the flow returns to step S31. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the second scanning of the image recording and the coating steps β1, during forward movement of the carriage 4 in the main scanning direction S, ink droplets of color inks are ejected from the first ejection area A1-*a*, and the UVLEDs 63*a* and 63*b* disposed in the area B1 of the ultraviolet-ray irradiation device 6*b* are turned on, and ink droplets of color inks are ejected from the first ejection area A1-*b*, and the UVLEDs 63*c* and 63*d* disposed in the area B2 of the ultraviolet-ray irradiation device 6*b* are turned on (step S31). In addition, during the return movement of the carriage 4 in the opposite direction to the main scanning direction S, UVLEDs 63 which irradiate the band recorded in step S31 with ultraviolet rays are turned on (step S32). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the second pass recording is performed using the color inks ejected from the first ejection area A1-*b* in the band in which the first pass recording has been performed using the color inks ejected from the first ejection area A1-*a* in the first scanning, and the color inks are irradiated with ultraviolet rays immediately after being landed on the medium M and are granularly cured. Thus, the overall recording (ejection of the color inks and curing of the color inks through irradiation with ultraviolet rays) using the color inks in the corresponding band is completed. Further, in the second scanning, in the same manner as in the first scanning, the first pass recording is performed using the color inks ejected from the first ejection area A1-*a*.

When the reciprocation of the carriage 4 in the main scanning direction S finishes, since the current scanning is the second scanning of the image recording and the coating steps β1 (step S33: NO), the Y bar 3 is transported by one band (pass width) in the sub-scanning direction F (step S34), and the flow returns to step S31. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the third scanning of the image recording and the coating steps β1, during forward movement of the carriage 4 in the main scanning direction S, ink droplets of color inks are ejected from the first ejection areas A1-*a* and A1-*b*, and the UVLEDs 63*a* to 63*d* disposed in the areas B1 and B2 of the ultraviolet-ray irradiation device 6*b* are turned on; and ink droplets of clear inks are ejected from the second ejection area A2-*a*, and the UVLEDs 63*e* and 63*f* disposed in the area B3 of the ultraviolet-ray irradiation device 6*b* are turned on (step S31). In addition, during the return movement of the carriage 4 in the opposite direction to the main scanning direction S, UVLEDs 63 which irradiate the band recorded in step S31 with ultraviolet rays are turned on (step S32). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the third pass recording is performed using the clear inks ejected from the second ejection area A2-*a* in the band in which the second pass recording has been performed using the color inks ejected from the first ejection area A1-*b* in the second scanning, and the clear inks are irradiated with ultraviolet rays immediately after being landed on the medium M and are granularly cured. Thus, coating of the first layer is performed on the image using the clear inks. Further, in the third scanning, in the same manner as in the first scanning, the first pass recording is performed using the color inks ejected from the first ejection area A1-*a*, and, in the same manner as in the second scanning, the second pass recording is performed using the color inks ejected from the first ejection area A1-*b*.

When the reciprocation of the carriage 4 in the main scanning direction S finishes, since the current scanning is the third scanning of the image recording and coating steps β1 (step S33: NO), the Y bar 3 is transported by one band (pass width) in the sub-scanning direction F (step S34), and the flow returns to step S31. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the fourth scanning of the image recording and the coating steps β1, during forward movement of the carriage 4 in the main scanning direction S, ink droplets of color inks are ejected from the first ejection areas A1-*a* and A1-*b*, and the UVLEDs 63*a* to 63*d* disposed in the areas B1 and B2 of the ultraviolet-ray irradiation device 6*b* are turned on; ink droplets of clear inks are ejected from the second ejection area A2-*a*, and the UVLEDs 63*e* and 63*f* disposed in the area B3 of the ultraviolet-ray irradiation device 6*b* are turned on; and ink droplets of clear inks are ejected from the second ejection area A2-*b*, and the UVLEDs 63*g* and 63*h* disposed in the area B4 of the ultraviolet-ray irradiation device 6*b* are turned on (step S31). In addition, during the return movement of the carriage 4 in the opposite direction to the main scanning direction S, UVLEDs 63 which irradiate the band recorded in step S31 with ultraviolet rays are turned on (step S32). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the fourth pass recording is performed using the clear inks ejected from the second ejection area A2-*b* in the band in which the third pass recording has been performed using the clear inks ejected from the second ejection area A2-*a* in the previous scanning, and the clear inks are irradiated with ultraviolet rays immediately after being landed on the medium M and are granularly cured. Thus, the coating of the second layer is performed on the image using the clear inks. Further, in the fourth scanning, in the same manner as in the first scanning, the first pass recording is performed using the color inks ejected from the first ejection area A1-*a*; in the same manner as in the second scanning, the second pass recording is performed using the color inks ejected from the first ejection area A1-*b*; and, in the same manner as in the third scanning, the third pass recording is performed using the clear inks ejected from the second ejection area A2-*a*.

When the reciprocation of the carriage 4 in the main scanning direction S finishes, since the current scanning is the fourth scanning of the image recording and coating steps β1, it is then determined whether or not the Y bar 3 is transported a predetermined number of times in the sub-scanning direction F (step S33).

In addition, if it is determined that the Y bar 3 has not been transported a predetermined number of times in the sub-scanning direction F (step S33: NO), the Y bar 3 is transported by one band (pass width) in the sub-scanning direction F (step S34), and the flow returns to step S31. Then, since the carriage 4 is moved by one band in the sub-scanning direction F, the ink jet heads 5 and the ultraviolet-ray irradiation devices 6 can be correlated with the next pass line, and a recording position for the medium proceeds to the front side in the sub-scanning direction F. Further, the above-described steps S31 to S33 are repeatedly performed until it is determined that the Y bar 3 has been transported a predetermined number of times in the sub-scanning direction F in step S33.

On the other hand, if it is determined that the Y bar 3 has been transported a predetermined number of times in the sub-scanning direction F (step S33: YES), the Y bar 3 is transported in the opposite direction to the sub-scanning direction F so as to return to the original position (the position in step S31 which is a printing start position) (step S35), and then the thickness heaping steps β2 is performed while sequentially transporting the Y bar 3 in the sub-scanning direction F.

As shown in FIG. 19B, in the first scanning of the thickness heaping steps β2, the carriage 4 is reciprocated in the main scanning direction S and in the opposite direction to the main scanning direction S without performing ejection of inks and irradiation of ultraviolet rays (steps S36 and S37). Then, blank printing is performed in the band disposed on the rearmost side in the sub-scanning direction F in the fifth pass. Here, the blank printing indicates that the carriage 4 is reciprocated in the main scanning direction S and in the opposite direction to the main scanning direction S without performing ejection of inks and irradiation of ultraviolet rays.

When the reciprocation of the carriage 4 in the main scanning direction S finishes, it is determined whether or not the Y bar 3 has been transported a predetermined number of times in the sub-scanning direction F (step S38). Here, in the thickness heaping steps β2, printing data is divided into a plurality of bands and is recorded while the Y bar 3 is sequentially transported in the sub-scanning direction F. In addition, since blank printing of two passes is performed through initial two scannings and recording of two passes is performed through subsequent two scannings using the clear inks, recording in each band is completed through four scannings (four passes). For this reason, the determination that the Y bar 3 has been transported a predetermined number of times in the sub-scanning direction F in step S38 is performed after the fourth scanning, and a predetermined number of times for which the Y bar 3 is transported in the sub-scanning direction F in the thickness heaping steps β2 is the division number of printing data +3.

In addition, since the current scanning is the first scanning of the thickness heaping steps β2, it is determined that the Y bar 3 has not been transported a predetermined number of times in the sub-scanning direction F (step S38: NO), the Y bar 3 is transported by one band (pass width) in the sub-scanning direction F (step S39), and the flow returns to step S36. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the second scanning of the thickness heaping steps β2, the carriage 4 is reciprocated in the main scanning direction S and in the opposite direction to the main scanning direction S without performing ejection of inks and irradiation of ultraviolet rays (steps S36 and S37). Then, blank printing is performed in the band disposed on the rearmost side in the sub-scanning direction F in the sixth pass, and blank printing is performed in a band adjacent to the band on the front side in the sub-scanning direction F in the fifth pass.

In addition, when the reciprocation of the carriage 4 in the main scanning direction S finishes, since the current scanning is the second scanning of the thickness heaping steps β2, it is determined that the Y bar 3 has not been transported a predetermined number of times in the sub-scanning direction F (step S38: NO), the Y bar 3 is transported by one band (pass width) in the sub-scanning direction F (step S39), and the flow returns to step S36. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the third scanning of the thickness heaping steps β2, during forward movement of the carriage 4 in the main scanning direction S, ink droplets of clear inks are ejected from the second ejection area A2-*a*, and the UVLEDs 63*e* and 63*f* disposed in the area B3 of the ultraviolet-ray irradiation device 6*b* are turned on (step S35). In addition, during the return movement of the carriage 4 in the opposite direction to the main scanning direction S, UVLEDs 63 which irradiate the band recorded in step S35 with ultraviolet rays are turned on (step S36). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the seventh pass recording is performed using the clear inks ejected from the second ejection area A2-*a* in the band disposed on the rearmost side in the sub-scanning direction F, and the clear inks are irradiated with ultraviolet rays immediately after being landed on the medium M and are granularly cured. Thus, the thickness of one layer is heaped up on the image formed through the image recording and coating steps β1.

In addition, when the reciprocation of the carriage 4 in the main scanning direction S finishes, since the current scanning is the third scanning of the thickness heaping steps β2, it is determined that the Y bar 3 has not been transported a predetermined number of times in the sub-scanning direction F (step S38: NO), the Y bar 3 is transported by one band (pass width) in the sub-scanning direction F (step S39), and the flow returns to step S36. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F.

In the fourth scanning of the thickness heaping steps β2, during forward movement of the carriage 4 in the main scanning direction S, ink droplets of clear inks are ejected from the second ejection area A2-*a*, and the UVLEDs 63*e* and 63*f* disposed in the area B3 of the ultraviolet-ray irradiation device 6*b* are turned on; and ink droplets of clear inks are ejected from the second ejection area A2-*b*, and the UVLEDs 63*g* and 63*h* disposed in the area B4 of the ultraviolet-ray irradiation device 6*b* are turned on (step S35). In addition, during the return movement of the carriage 4 in the opposite direction to the main scanning direction S, UVLEDs 63 which irradiate the band recorded in step S35 with ultraviolet rays are turned on (step S36). Further, during the return movement of the carriage 4 in the opposite direction to the main scanning direction S, the UVLEDs 63 of both the ultraviolet-ray irradiation device 6*a* and the ultraviolet-ray irradiation device 6*b* may be turned on, or the UVLEDs 63 of either one may be turned on. Then, the eighth pass recording is performed using clear inks ejected from the second ejection area A2-*b* in the band in which the seventh pass recording was performed using the clear inks ejected from the second ejection area A2-*a* one scanning ago, and the clear inks are irradiated with ultraviolet rays immediately after being landed on the medium M and are granularly cured. Thus, the thickness of two layers is heaped up on the image formed through the image recording and the coating steps β1. In addition, in the fourth scanning, in the same manner as in the third scanning, the seventh pass recording is performed using the clear inks ejected from the second ejection area A2-*a*.

When the reciprocation of the carriage 4 in the main scanning direction S finishes, since the current scanning is the fourth scanning of the thickness heaping steps β2, it is then determined whether or not the Y bar 3 has been transported a predetermined number of times in the sub-scanning direction F (step S38).

In addition, if it is determined that the Y bar 3 has not been transported a predetermined number of times in the sub-scanning direction F (step S38: NO), the Y bar 3 is transported by one band (pass width) in the sub-scanning direction F (step S39), and the flow returns to step S36. Then, since the carriage 4 mounted on the Y bar 3 is also moved by one band in the sub-scanning direction F, the ink jet heads 5 and the ultraviolet-ray irradiation devices 6 can be correlated with the next pass line, and a recording position for the medium proceeds to the front side in the sub-scanning direction F. Further, the above-described steps S36 to S38 are repeatedly performed until it is determined that the Y bar 3 has been transported a predetermined number of times in the sub-scanning direction F in step S38.

Here, a description will be made of a method of recording a final band through the image recording steps α1 when the final scanning is an m-th scanning.

In the m-th scanning which is the final scanning, during forward movement of the carriage 4 in the main scanning direction S, ejection of the clear inks from the second ejection area A2-*a* stops, and the UVLEDs 63*e* and 63*f* disposed in the area B3 are turned off; and, clear inks ejected from only the second ejection area A2-*b* are ejected, and only the UVLEDs 63*g* and 63*h* disposed in the area B4 of the ultraviolet-ray irradiation device 6*b* are turned on (step S36). In addition, during the return movement of the carriage 4 in the opposite direction to the main scanning direction S, only the UVLEDs 63*g* and 63*h* disposed in the area B4 are turned on (step S37). Then, the eighth pass recording is performed using the clear inks ejected from the second ejection area A2-*b* in the final band recorded using the clear inks ejected from the second ejection area A2-*a* in the previous scanning, and ultraviolet rays are applied from the UVLEDs 63*g* and 63*h* disposed in the area B4 thereto.

Thus, one image recording step α1 in the thickness heaping steps β2 finishes in a state in which the second ejection area A2-*b* is disposed in the pass line of the final band.

On the other hand, if it is determined that the Y bar 3 has been transported a predetermined number of times in the sub-scanning direction F (step S38: YES), it is then determined whether or not the thickness heaping steps β2 have been performed a predetermined number of times (step S40). Here, the thickness heaping steps β2 are repeatedly performed a necessary number of times so as to heap the clear inks to a predetermined thickness. In addition, a predetermined number of times for which the thickness heaping steps β2 are repeatedly performed is specified using a predetermined set value, a value designated in printing data, or the like. For this reason, in step S40, it is determined that a number of times of the current thickness heaping steps β2 does not arrive at a predetermined number of times when a number of times of the current thickness heaping steps does not arrive at a predetermined number of times, and it is determined that a number of times of the current thickness heaping steps β2 arrives at a predetermined number of times when a number of times of the current thickness heaping steps arrives at a predetermined number of times.

If it is determined that the thickness heaping steps β2 has not been performed a predetermined number of times (step S40: NO), the flow returns to step S35, and the above-described steps S35 to S40 are repeatedly performed again.

On the other hand, if it is determined that the thickness heaping steps β2 has been performed a predetermined number of times (step S40: YES), the gloss process steps β3 is then performed while the Y bar 3 is sequentially transported in the opposite direction to the sub-scanning direction F.

As shown in FIG. 19C, in the first scanning of the gloss process steps β3, during forward movement of the carriage 4 in the main scanning direction S, ink droplets of clear inks are ejected from the second ejection area A2-*b*, and the UVLEDs 63*g* and 63*h* disposed in the area B4 of the ultraviolet-ray irradiation device 6*a* and the ultraviolet-ray irradiation device 6*b* are turned off (step S41). In addition, during the return movement of the carriage 4 in the opposite direction to the main scanning direction S, the UVLEDs 63*g* and 63*h* disposed in the band in which the clear inks are recorded in step S41 are turned off (step S42). At this time, the second ejection area A2-*b* is disposed in the pass line of the final band in the thickness heaping steps β2. For this reason, if the number of all passes in the thickness heaping quality mode is n, the (n−3)-th pass recording is performed using clear inks ejected from the second ejection area A2-*b* in the band which is the final band of the thickness heaping steps β2 and is disposed on the frontmost side in the sub-scanning direction F. At this time, since the UVLEDs 63*g* and 63*h* are turned off which are disposed in the area B4 and irradiate the band in which clear inks ejected from the second ejection area A2-*b* are recorded with ultraviolet rays, the clear inks in the (n−3)-th pass which have been landed on the medium M are not cured but gradually wettedly spread so as to decrease the thickness, and therefore the uneven surfaces thereof are smoothed out. In addition, in the first scanning, the UVLEDs 63*a* to 63*d* disposed in the areas B1 and B2 may be turned on or off.

When the reciprocation of the carriage 4 in the main scanning direction S finishes, it is determined whether or not the Y bar 3 has been transported a predetermined number of times in the opposite direction to the sub-scanning direction F (step S43). Here, in the gloss process steps β3, printing data is divided into a plurality of bands and is recorded while the Y bar 3 is sequentially transported in the opposite direction to the sub-scanning direction F. In addition, since recording of two passes using the clear inks is performed through initial two scannings and the clear inks recorded in each band are irradiated with ultraviolet rays through subsequent two scannings in each band, recording in each band is completed through four scannings (four passes). For this reason, the determination that the Y bar 3 has been transported a predetermined number of times in the opposite direction to the sub-scanning direction F in step S43 is performed after the fourth scanning, and a predetermined number of times for which the Y bar 3 is transported in the opposite direction to the sub-scanning direction F in the gloss process steps β3 is the division number of printing data +3.

In addition, since the current scanning is the first scanning of the gloss process steps β3, it is determined that the Y bar 3 has not been transported a predetermined number of times in the opposite direction to the sub-scanning direction F (step S43: NO), the Y bar 3 is transported by one band (pass width) in the opposite direction to the sub-scanning direction F (step S44), and the flow returns to step S41. Then, since the carriage 4 mounted on the Y bar 3 is also moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F.

In the second scanning of the gloss process steps β3, during forward movement of the carriage 4 in the main scanning direction S, ink droplets of clear inks are ejected from the second ejection area A2-*b*, and the UVLEDs 63*g* and 63*h* disposed in the area B4 of the ultraviolet-ray irradiation device 6*a* and the ultraviolet-ray irradiation device 6*b* are turned off; and ink droplets of clear inks are ejected from the second ejection area A2-*a*, and the UVLEDs 63*e* and 63*f* disposed in the area B3 of the ultraviolet-ray irradiation device 6*a* and the ultraviolet-ray irradiation device 6*b* are turned off (step S41). In addition, during the return movement of the carriage 4 in the opposite direction to the main scanning direction S, the UVLEDs 63*e* to 63*h* disposed in the band in which the clear inks are recorded in step S41 are turned off (step S42). Then, the (n−2)-th pass recording is performed using the clear inks ejected from the second ejection area A2-*a* in the band in which the (n−3)-th pass recording has been performed using clear inks ejected from the second ejection area A2-*b* in the first scanning. At this time, since the UVLEDs 63*e* and 63*f* are turned off which are disposed in the area B3 and irradiate the band in which clear inks ejected from the second ejection area A2-*b* are recorded with ultraviolet rays, the clear inks in the (n−2)-th pass which have been landed on the medium M are not cured but gradually wettedly spread so as to decrease the thickness along with the clear inks in the (n−3)-th pass, and therefore the uneven surfaces thereof are smoothed out. In addition, in the second scanning, in the same manner as in the first scanning, the (n−3)-th pass recording is performed using the clear inks ejected from the second ejection area A2-*b*. Further, in the second scanning, the UVLEDs 63*a* to 63*d* disposed in the areas B1 and B2 may be turned on or off.

When the reciprocation of the carriage 4 in the main scanning direction S finishes, since the current scanning is the second scanning of the gloss process steps β3 (step S43: NO), the Y bar 3 is transported by one band (pass width) in the opposite direction to the sub-scanning direction F (step S44), and the flow returns to step S41. Then, since the carriage 4 mounted on the Y bar 3 is also moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F.

In the third scanning of the gloss process steps β3, during forward movement of the carriage 4 in the main scanning direction S, ink droplets of clear inks are ejected from the second ejection areas A2-*a* and A2-*b*, and the UVLEDs 63*e* to 63*h* disposed in the areas B3 and B4 of the ultraviolet-ray irradiation device 6*a* and the ultraviolet-ray irradiation device 6*b* are turned off; and the UVLEDs 63*c* and 63*d* disposed in the area B2 are turned on (step S41). In addition, during the return movement of the carriage 4 in the opposite direction to the main scanning direction S, the UVLEDs 63*c* and 63*d* disposed in the area B2 are turned on (step S42). Further, the UVLEDs 63*c* and 63*d* to be turned on may be those of both of the ultraviolet-ray irradiation device 6*a* and the ultraviolet-ray irradiation device 6*b*, or may be those of either one. Then, in the (n−1)-th pass, ultraviolet rays are applied from the UVLEDs 63*c* and 63*d* disposed in the area B2 to the band in which the (n−2)-th pass recording was performed using the clear inks ejected from the second ejection area A2-*a* in the second scanning one scanning ago, and thus the clear inks in the (n−3)-th and (n−2)-th passes start to be cured in a state of being sufficiently smoothed. In addition, in the third scanning, in the same manner as in the first scanning, the (n−3)-th pass recording is performed using the clear inks ejected from the second ejection area A2-*b*, and, in the same manner as in the second scanning, the (n−2)-th pass recording is performed using the clear inks ejected from the second ejection area A2-*a*.

When the reciprocation of the carriage 4 in the main scanning direction S finishes, since the current scanning is the third scanning of the gloss process steps β3 (step S43: NO), the Y bar 3 is transported by one band (pass width) in the opposite direction to the sub-scanning direction F (step S44), and the flow returns to step S41. Then, since the carriage 4 mounted on the Y bar 3 is also moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F.

In the fourth scanning of the gloss process steps β3, during forward movement of the carriage 4 in the main scanning direction S, ink droplets of clear inks are ejected from the second ejection areas A2-*a* and A2-*b*, and the UVLEDs 63*e* to 63*h* disposed in the areas B3 and B4 of the ultraviolet-ray irradiation device 6*a* and the ultraviolet-ray irradiation device 6*b* are turned off; the UVLEDs 63*c* and 63*d* disposed in the area B2 are turned on; and the UVLEDs 63*a* and 63*b* disposed in the area B1 are turned on (step S41). In addition, during the return movement of the carriage 4 in the opposite direction to the main scanning direction S, the UVLEDs 63*a* to 63*d* disposed in the areas B1 and B2 are turned on (step S42).

Further, the UVLEDs 63*a* to 63*d* to be turned on may be those of both of the ultraviolet-ray irradiation device 6*a* and the ultraviolet-ray irradiation device 6*b*, or may be those of either one. Then, in the n-th pass which is a final pass, ultraviolet rays are applied from the UVLEDs 63*a* and 63*b* disposed in the area B1 to the band which was irradiated with ultraviolet rays by the UVLEDs 63*c* and 63*d* disposed in the area B2 in the third scanning one scanning ago, such that curing of the clear inks is sufficiently promoted. In addition, in the fourth scanning, in the same manner as in the first scanning, the (n−3)-th pass recording is performed using the clear inks ejected from the second ejection area A2-*b*; in the same manner as in the second scanning, the (n−2)-th pass recording is performed using the clear inks ejected from the second ejection area A2-*a*; and, in the same manner as in the third scanning, ultraviolet rays are applied to the band in which the (n−2)-th pass recording was performed one scanning ago.

When the reciprocation of the carriage 4 in the main scanning direction S finishes, since the current scanning is the fourth scanning of the gloss process steps β3, it is then determined whether or not the Y bar 3 has been transported a predetermined number of times in the opposite direction to the sub-scanning direction F (step S43).

In addition, if it is determined that the Y bar 3 has not been transported a predetermined number of times in the opposite direction to the sub-scanning direction F (step S43: NO), the Y bar 3 is transported by one band (pass width) in the opposite direction to the sub-scanning direction F (step S44), and the flow returns to step S41. Then, since the carriage 4 is moved by one band in the opposite direction to the sub-scanning direction F, the ink jet heads 5 and the ultraviolet-ray irradiation devices 6 can be correlated with the next pass line, and a recording position for the medium proceeds in the opposite direction to the sub-scanning direction F. Further, the above-described steps S41 to S43 are repeatedly performed until it is determined that the Y bar 3 has been transported a predetermined number of times in the opposite direction to the sub-scanning direction F in step S43.

On the other hand, if it is determined that the Y bar 3 has been transported a predetermined number of times in the sub-scanning direction F (step S43: YES), the printing process in the gloss quality mode finishes.

Therefore, since the thickness-heaping layers of the clear inks having thickness are laminated on the upper layer of an image recorded on the medium M, and the smoothed clear inks are recorded thereon, it is possible to secure visibility of the image, to make the clear inks have thickness, and to give glossiness to the image.

In addition, in steps S41 and S42, in the same manner as in steps S15 and S16 of the gloss quality mode, an amount of light emitted from the UVLEDs 63 (the UVLEDs 63*c* and 63*d*) disposed in the area B2 is preferably smaller than an amount of light emitted from the UVLEDs (the UVLEDs 63*a* and 63*b*) disposed in the area B1. Further, in the same manner as in the gloss quality mode, since the underlying clear inks are granularly cured in the thickness heaping steps β2 preceding the gloss process steps β3, movement of the overlying clear inks are activated, and thus it is possible to increase speed at which the clear inks are smoothed.

In addition, in steps S41 and S42, in the same manner as in steps S15 and S16 of the gloss quality mode, a dust removal step is preferably performed using the above-described dust removal means (the dust removal means and the dust removal operation have been described). According thereto, it is possible to prevent dust from being attached to surfaces of ink droplets of clear inks until the clear inks are irradiated with ultraviolet rays and are cured after the clear inks are ejected onto the medium M. In other words, since image quality of glossy printing is prevented from deteriorating, it is possible to realize high gloss image quality with sufficient glossiness.

As above, according to the ink jet recording apparatus 1 related to the present embodiment, the UVLED 63 is provided so as to correspond to each band, and thus it is possible to control whether or not to apply ultraviolet rays for each band. For this reason, UVLEDs 63 are turned off which irradiate a band in which a pass area for ejecting ink droplets is located with ultraviolet rays, and thus ink droplets ejected from the pass area are not cured immediately after being landed on the medium M but are smoothed. Therefore, it is possible to perform recording with sufficient glossiness. On the other hand, UVLEDs 63 are turned on which irradiate a band in which a pass area for ejecting ink droplets is located with ultraviolet rays, and thus ink droplets ejected from the pass area are cured immediately after being landed on the medium M, thereby forming an image with matte image quality.

In addition, since the UVLEDs 63 of the areas B1 and B2 are turned on, color inks ejected from the first ejection area A1 are cured immediately after being landed on the medium M, and thus it is possible to form a clear color image without smearing of inks. On the other hand, since the UVLEDs 63 of the areas B2 and B3 are turned off, clear inks ejected from the second ejection area A2 are not cured immediately after being landed on the medium M but are smoothed, and thus it is possible to give sufficient glossiness to an image or the like formed in the lower layer.

At this time, since clear inks are ejected from the second ejection area A2, and the Y bar 3 is moved in the opposite direction to the sub-scanning direction F, the clear inks landed on the medium M are irradiated with ultraviolet rays and are cured in the subsequent scannings. Thus, since ejection of clear inks and curing of smoothed clear inks can be performed without changing movement directions of the Y bar 3, it is possible to efficiently perform glossy recording.

In addition, in the gloss quality mode, as described above, smoothed clear inks are recorded on the upper layer of an image recorded on the medium M, and thus it is possible to secure visibility of the image and to give glossiness to the image.

At this time, since color inks are ejected from the first ejection area A1, and clear inks are ejected from the second ejection area A2, the color inks are recorded on the medium M when the Y bar 3 moves in the sub-scanning direction F, and then the clear inks are recorded on the upper layer of the color inks when the Y bar 3 moves in the opposite direction to the sub-scanning direction F. As above, since an image can be formed and be given glossiness through a single reciprocation of the Y bar 3, it is possible to efficiently perform recording an image with glossiness.

In addition, since air sucking means or blowing means is operated, it is possible to prevent dust from being attached to surfaces of ink droplets of clear inks until the clear inks are irradiated with ultraviolet rays and are cured and to thereby realize high gloss image quality with sufficient glossiness.

In addition, in the thickness heaping quality mode, as described above, since the thickness-heaping layers of the clear inks having thickness are laminated on the upper layer of an image recorded on the medium M, and the smoothed clear inks are recorded thereon, it is possible to secure visibility of the image, to make the clear inks have thickness, and to give glossiness to the image.

Further, since the ultraviolet-ray irradiation devices 6 are disposed on the front side and the rear side of the first ejection area A1 and the second ejection area A2 in the main scanning direction S, it is possible to cure all ink droplets ejected from ink nozzles through a single scanning in which the carriage is reciprocated in the main scanning direction.

Although the preferred embodiment of the present invention has been described above, the present invention is not limited to the above-described embodiment. For example, the number or an arrangement of the UVLEDs 63 installed in the ultraviolet-ray irradiation device 6, the number or an arrangement of the partition plates 64 installed in the ultraviolet-ray irradiation device 6, turning-on control of each UVLED 63, and the like are appropriately set depending on a desired illuminance distribution, a desired image quality of an image, or the like.

Figure 20:
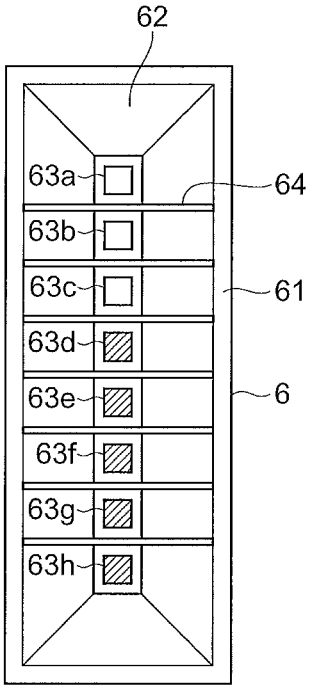
FIG. 20 is a diagram illustrating the ultraviolet-ray irradiation device in which seven partition plates are installed.

In addition, although, in the above-described embodiment, a case where three partition plates 64 are installed in the ultraviolet-ray irradiation device 6 has been described as description of the printing process method, any number of partition plates 64 may be installed, and seven partition plates 64 may be installed as shown in FIG. 20. In this case, in the coating steps α2 of the gloss quality mode, the UVLEDs 63*a* to 63*c* are turned on, and the UVLEDs 63*d* to 63*h* are turned off, thereby achieving an effect equivalent to a case of reducing an amount of light emitted from the UVLEDs 63 disposed in the area B2.

Further, although, in the above-described embodiment, a description has been made that ink droplets are ejected only in the forward path of the carriage 4 moving in the main scanning direction S in the description of the printing control method, ink droplets may be ejected in both of forward path and return path of the carriage 4 moving in the main scanning direction S.

Figure 22:
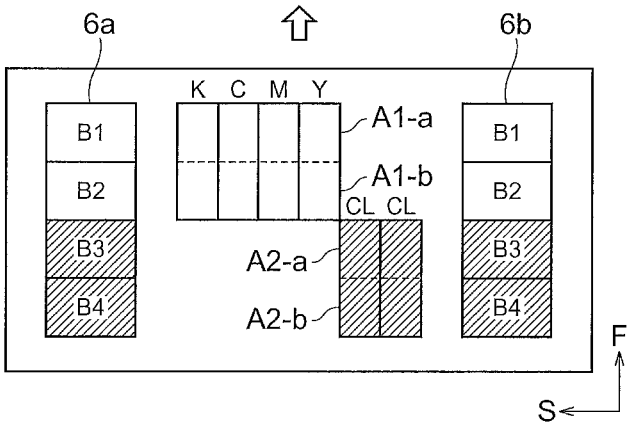
FIG. 22 is a diagram illustrating a turning-on control example of the UVLEDs in an image recording step in the gloss quality mode.

In addition, although, in the above-described embodiment, a description has been made that all the UVLEDs 63 are turned on in the image recording steps α1 of the gloss quality mode, for example, as shown in FIG. 22, the UVLEDs 63 disposed in the area B3 and the area B4 may be turned off in order to suppress color inks from being excessively cured. Thus, since the color inks are not irradiated with ultraviolet rays until the coating steps α2 after being irradiated with the ultraviolet rays during the second pass recording, the color inks are suppressed from being much cured, thereby increasing adhesiveness of the color inks and the clear inks.

In addition, although, in the above-described embodiment, a description has been made that three kinds of steps including the image recording and the coating steps β1, the thickness heaping steps β2, and the gloss process steps β3 are performed as the thickness heaping quality mode, the thickness heaping steps β2 are not necessarily required to be performed, and, for example, two kinds of steps including the image recording and the coating steps β1 and the gloss process steps β3 may be performed as the thickness heaping quality mode.

Figure 21:
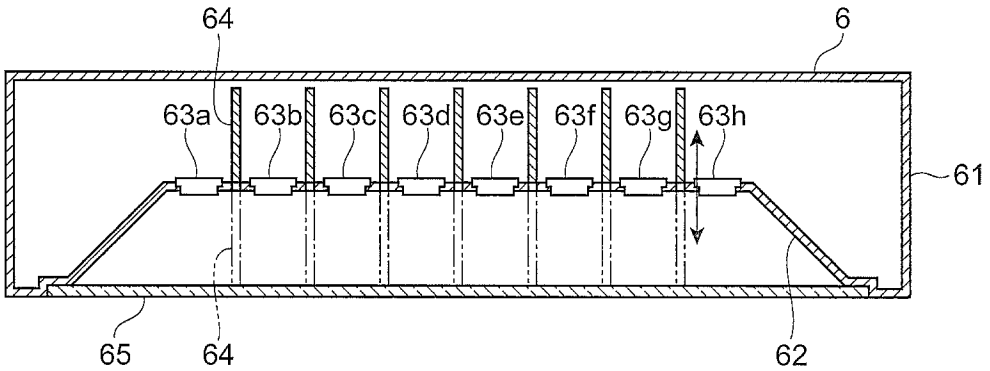
FIG. 21 is a cross-sectional view in the sub-scanning direction of the ultraviolet-ray irradiation device in which the partition plates can be moved between the main body and the recess.

Further, although, in the above-described embodiment, operations of inserting and removing the partition plates 64 into and from the ultraviolet-ray irradiation device 6 have not been described in detail, for example, the partition plates 64 may be inserted and removed into and from the opening of the recess 62 after detaching the cover 65, and, as shown in FIG. 21, the partition plates 64 are configured to be withdrawn to inside of the main body 61, and the partition plates 64 may be moved between the main body 61 and the recess 62. In this case, movement of each of the partition plates 64 may be performed through control using an actuator, a lead screw, or the like, or may be performed by projecting a knob physically fixed to each of the partition plates 64 from the main body 61 and operating this knob.

In addition, although, in the above-described embodiment, a description has been made that the partition plate 64 is formed in a trapezoidal plate shape, any shape may be employed as long as ultraviolet rays in the sub-scanning direction F can be shielded.

Figure 23A:
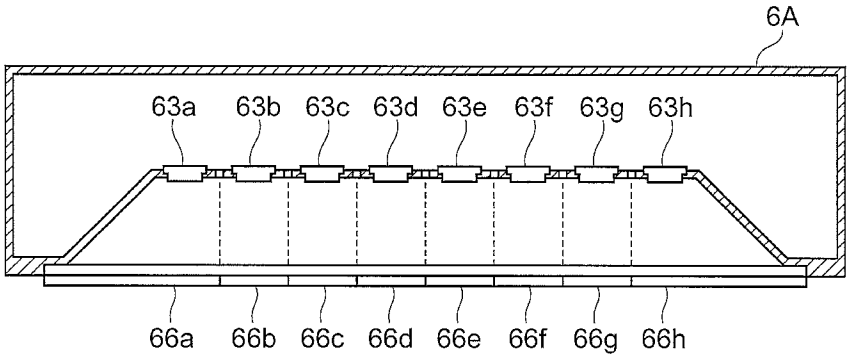
FIGS. 23A and 23B are diagrams illustrating another configuration example of the ultraviolet-ray irradiation device.
Figure 23B:
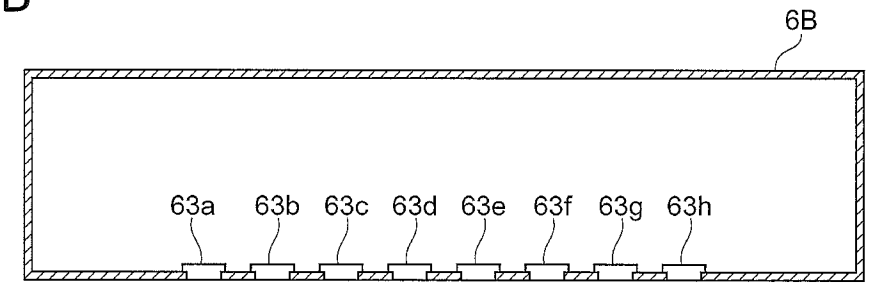

Further, although, in the above-described embodiment, a description has been made that the partition plates 64 are provided in the ultraviolet-ray irradiation device 6 so as to control proceeding of ultraviolet rays emitted from the UVLEDs 63 in the sub-scanning direction F, the partition plates 64 are not essential constituent elements, and irradiation illuminance of ultraviolet rays applied to ultraviolet-ray curable inks may be changed in the sub-scanning direction F by individually controlling turning-on of each UVLED 63. For example, as shown in an ultraviolet-ray irradiation device 6A of FIG. 23A, shield means 66*a* to 66*h* may be provided on the vertical lower sides of the respective UVLEDs 63*a* to 63*h*, and ultraviolet rays emitted from the adjacent UVLEDs 63 may be suppressed from being applied to the vertical lower sides of the turned-on UVLEDs 63, thereby changing irradiation illuminance of the ultraviolet rays in the sub-scanning direction F. In addition, as shown in an ultraviolet-ray irradiation device 6B of FIG. 23B, respective UVLEDs 63*a* to 63*h* may be disposed at the bottom of the ultraviolet-ray irradiation device 63 without forming a recess, and ultraviolet rays emitted from the adjacent UVLEDs 63 may be suppressed from being applied to the vertical lower sides of the turned-on UVLEDs 63, thereby changing irradiation illuminance of the ultraviolet rays in the sub-scanning direction F.

In addition, although, in the above-described embodiment, a description has been made that the ultraviolet-ray irradiation devices 6 are disposed on both the front side and the rear side of the ink jet heads 5 in the main scanning direction S, the ultraviolet-ray irradiation devices may be disposed on either the front side or the rear side of the ink jet heads 5 in the main scanning direction S.

Further, although, in the above-described embodiment, a description has been made that the ultraviolet-ray irradiation device 6*a* has the same configuration as the ultraviolet-ray irradiation device 6*b*, both of the two do not necessarily have the same configuration, and may appropriately have different configurations within the scope without departing from the spirit of the present invention.

In addition, although, in the above-described embodiment, a description has been made that areas for ejecting ink droplets are specified in the ink nozzles 8 formed in each of the ink jet heads 5 such that a band in which color inks are recorded and a band in which clear inks are recorded are shifted in the sub-scanning direction F, an ink jet head ejecting color inks and an ink jet head ejecting clear inks may be physically shifted in the sub-scanning direction F such that a band in which color inks are recorded and a band in which clear inks are recorded are shifted in the sub-scanning direction F.

Further, although, in the above-described embodiment, a description has been made that a nozzle string of the ink nozzles 8 forming each band is arranged in a line in the sub-scanning direction F, a nozzle string of the ink nozzles 8 may be shifted in the main scanning direction S for each band or a plurality of bands by arranging a plurality of ink jet heads 5 in the main scanning direction S, or the like. In addition, although, in the above-described embodiment, a description has been made that the ink nozzles 8 ejecting color inks and the ink nozzles 8 ejecting clear inks are shifted in the main scanning direction S and are arranged, these ink nozzles may be arranged in a line in the sub-scanning direction F. In this case, ink nozzles ejecting color inks and ink nozzles ejecting clear inks may be formed in different ink jet heads, or may be formed in the same ink jet head.

Further, although, in the above-described embodiment, the UVLED 63 is used as a light source of the ultraviolet-ray irradiation device 6, any means such as a UV lamp may be used as long as it can emit ultraviolet rays.

Further, although, in the above-described embodiment, a description has been made that the ink jet heads 5 and the medium M are relatively moved in the sub-scanning direction F by moving the ink jet heads 5 through transport of the Y bar 3, either of the ink jet heads 5 and the medium M may be practically moved, or both of the two may be moved. For example, a grid rolling type may be used in which the ink jet heads 5 and the medium M are relatively moved in the sub-scanning direction F by transporting the medium M.

Obviously, numerous modifications and variations of the present invention are possible in light of the above teachings. It is therefore to be understood that within the scope of the appended claims, the invention may be practiced otherwise than as specifically described herein.

What is claimed is:

1. An ink jet recording apparatus comprising:

a carriage movable in a main scanning direction and relatively movable with respect to a recording medium a sub-scanning direction perpendicular to the main scanning direction;

an ink ejector mounted on the carriage and including a plurality of ink nozzles which are provided in the sub-scanning direction to eject ultraviolet-ray curable inks on the recording medium and which are arranged in a plurality of pass areas to record a plurality of bands;

an ultraviolet-ray irradiator which is mounted on the carriage to irradiate the recording medium with ultraviolet rays and which includes a plurality of light sources to irradiate the plurality of bands with ultraviolet rays, respectively;

a controller configured to control the ink ejector and the plurality of light sources of the ultraviolet-ray irradiator to be turned on and turned off corresponding to respective pass areas; and a gas flowing device comprising at least one of an air sucking device to suck air on the recording medium side and a blowing device to blow a gas toward the recording medium side, wherein the controller is configured such that a light source is turned on which irradiates the band where a pass area disposed on an upstream side in the sub-scanning direction so as to be adjacent to a pass area for ejecting the light-transmissive ultraviolet-ray curable inks is located with ultraviolet rays such that the ultraviolet-ray curable inks are irradiated with ultraviolet rays, and a light amount of ultraviolet rays applied from the light source disposed on a downstream side in the sub-scanning direction is smaller than a light amount of ultraviolet rays applied from the light source disposed on an upstream side in the sub-scanning direction.

2. The ink jet recording apparatus according to claim 1, wherein the air sucking device is disposed at a front end or a rear end of the carriage in the scanning direction.

3. The ink jet recording apparatus according to claim 1, wherein the blowing device is disposed at a front end or a rear end of the carriage in the scanning direction and is configured to blow a gas in a direction substantially perpendicular to the scanning direction.

4. The ink jet recording apparatus according to claim 1, wherein the blowing device is disposed at a front end of the carriage in the scanning direction and is configured to blow a gas toward a front side in the scanning direction.

5. A printing method using an ink jet recording apparatus comprising a carriage movable in a main scanning direction and relatively movable with respect to a recording medium in a sub-scanning direction perpendicular to the main scanning direction, an ink ejector mounted on the carriage and including a plurality of ink nozzles which are provided in the sub-scanning direction to eject ultraviolet-ray curable inks on the recording medium and which are arranged in a plurality of pass areas to record a plurality of bands, an ultraviolet-ray irradiator which is mounted on the carriage to irradiate the recording medium with ultraviolet rays and which includes a plurality of light sources to irradiate the plurality of bands with ultraviolet rays, respectively, a controller configured to control the ink ejector and the plurality of light sources of the ultraviolet-ray irradiator to be turned on and turned off corresponding to respective pass areas, and a gas flowing device comprising at least one of an air sucking device to suck air on the recording medium side and a blowing device to blow a gas toward the recording medium side in which the light source irradiating the band where a pass area for ejecting light-transmissive ultraviolet-ray curable inks is located with ultraviolet rays is turned off, and the light-transmissive ultraviolet-ray curable inks are recorded on the recording medium, the method comprising:

a step of turning on the light source irradiating the band where a pass area disposed further toward an upstream side of the carriage or the recording medium in the sub-scanning direction than the pass area for ejecting the light-transmissive ultraviolet-ray curable inks is located with ultraviolet rays, so as to cure the ultraviolet-ray curable inks recorded on the recording medium in subsequent scannings; and a step of sucking air on the recording medium side by operating the air sucking device or a step of blowing a gas toward the recording medium side by operating the blowing device before, when, or after the ultraviolet-ray curable inks are ejected, wherein the light source is turned on which irradiates the band where a pass area disposed on an upstream side in the sub-scanning direction so as to be adjacent to the pass area for ejecting the light-transmissive ultraviolet-ray curable inks is located with ultraviolet rays such that the ultraviolet-ray curable inks are irradiated with ultraviolet rays, and a light amount of ultraviolet rays applied from the light source disposed on a downstream side in the sub-scanning direction is smaller than a light amount of ultraviolet rays applied from the light source disposed on an upstream side in the sub-scanning direction.

6. The printing method according to claim 5, wherein the air sacking device is disposed at a front end or a rear end of the carriage in the scanning direction.

7. The printing method according to claim 5, wherein the blowing device is disposed at a front end or a rear end of the carriage in the scanning direction and is configured to blow a gas in a direction substantially perpendicular to the scanning direction.

8. The printing method according to claim 5, wherein the blowing device is disposed at a front end of the carriage in the scanning direction and is configured to blow a gas toward a front side in the scanning direction.

* * * * *